US008028529B2

(12) United States Patent
Venkataraman et al.

(10) Patent No.: US 8,028,529 B2
(45) **Date of Patent: *Oct. 4, 2011**

(54) LOW EMISSIONS GAS TURBINE COMBUSTOR

(75) Inventors: Krishna K. Venkataraman, Simpsonville, SC (US); William Kirk Hessler, Greer, SC (US); Predrag Popovic, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 632 days.

This patent is subject to a terminal disclaimer.

(21) Appl. No.: 12/219,929

(22) Filed: Jul. 30, 2008

(65) Prior Publication Data

US 2009/0019855 A1 Jan. 22, 2009

Related U.S. Application Data

(63) Continuation-in-part of application No. 11/531,045, filed on Sep. 12, 2006, now Pat. No. 7,887,322, and a continuation-in-part of application No. 11/418,239, filed on May 4, 2006, and a continuation-in-part of application No. 12/219,534, filed on Jul. 23, 2008, and a continuation-in-part of application No. 12/180,879, filed on Jul. 28, 2008.

(51) Int. Cl.
*F02C 1/00* (2006.01)

(52) U.S. Cl. ..... 60/752; 165/169

(58) Field of Classification Search ..... 60/804, 60/747, 740, 746, 737, 733, 722, 752; 165/169, 165/156; 431/10, 351, 353
See application file for complete search history.

(56) References Cited

U.S. PATENT DOCUMENTS

| | | | | |
|---|---|---|---|---|
| 4,179,880 | A | 12/1979 | Schirmer | |
| 4,374,637 | A * | 2/1983 | Zwick et al. | 431/183 |
| 5,025,622 | A * | 6/1991 | Melconian | 60/39.464 |
| 5,289,686 | A | 3/1994 | Razdan et al. | |
| 6,038,861 | A | 3/2000 | Amos et al. | |
| 6,427,446 | B1 | 8/2002 | Kraft et al. | |
| 6,769,903 | B2 | 8/2004 | Eroglu et al. | |
| 7,614,234 | B2 * | 11/2009 | Cazalens et al. | 60/746 |
| 7,921,653 | B2 * | 4/2011 | Som et al. | 60/782 |
| 2005/0204741 | A1 | 9/2005 | Simons et al. | |
| 2005/0217276 | A1 | 10/2005 | Colibaba-Evulet et al. | |
| 2007/0130955 | A1 | 6/2007 | Vandale et al. | |
| 2007/0256423 | A1 | 11/2007 | Hessler et al. | |
| 2008/0060358 | A1 | 3/2008 | Popovic et al. | |
| 2010/0034441 | A1 * | 2/2010 | Makram-Ebeid et al. | 382/128 |
| 2010/0077762 | A1 * | 4/2010 | Hessler et al. | 60/752 |
| 2010/0107645 | A1 * | 5/2010 | Kollati | 60/752 |

* cited by examiner

*Primary Examiner* — Ehud Gartenberg
*Assistant Examiner* — Vikansha Dwivedi
(74) *Attorney, Agent, or Firm* — Nixon & Vanderhye P.C.

(57) ABSTRACT

A gas turbine combustor including: a primary combustion chamber; a secondary combustion chamber downstream of the primary combustion chamber; a venturi having a venturi throat; a transition piece; a cap assembly attached to the primary combustion chamber, and an external turbulator member in operable communication with the cap assembly, wherein the primary combustion chamber includes a mixing hole arrangement for improving homogeneity of an air and fuel mixture in the combustor; the venturi throat is disposed within a predetermined distance upstream from the downstream end of the primary combustion chamber; the transition piece is composed of a duct body, with a plurality of dilution holes formed in the duct body; and the external turbulator member includes a step positioned at the second end of the centerbody, the step defining a radial distance about the second end of the centerbody.

18 Claims, 28 Drawing Sheets

201

2001

Distance from nozzle end

Degree disposal about the liner

| degree | 1st col. 3.65 " | 2nd col. 4.9 " | 3rd col. 6.15" |
|---|---|---|---|
| 0 | 0.98 | | |
| 12 | | 0.71 | |
| 24 | | | 0.59 |
| 36 | 0.98 | | |
| 48 | | | 0.59 |
| 60 | | 0.71 | |
| 72 | 0.98 | | |
| 84 | | | 0.59 |
| 90 | | 0.71 | |
| 108 | 0.98 | | |
| 126 | | 0.71 | |
| 132 | | | 0.59 |
| 144 | 0.98 | | |
| 156 | | | 0.59 |
| 168 | | 0.71 | |
| 180 | 0.98 | | |
| 192 | | 0.71 | |
| 204 | | | 0.59 |
| 216 | 0.98 | | |
| 228 | | | 0.59 |
| 234 | | 0.71 | |
| 252 | 0.98 | | |
| 270 | | 0.71 | |
| 276 | | | 0.59 |
| 288 | 0.98 | | |
| 300 | | | 0.59 |
| 312 | | 0.71 | |
| 324 | 0.98 | | |
| 336 | | | 0.59 |
| 348 | | 0.71 | |

Fig. 15

301

3001

Distance from nozzle end

Degree Disposal about the liner

| degree | first col. 3.65" | 2nd col. 4.9" | 3rd col. 6.15" |
|---|---|---|---|
| 0 | | | 0.777 |
| 12 | | 0.777 | |
| 24 | 0.777 | | |
| 36 | | | 0.777 |
| 48 | 0.777 | | |
| 60 | | 0.777 | |
| 72 | | | 0.777 |
| 84 | 0.777 | | |
| 90 | | 0.777 | |
| 108 | | | 0.777 |
| 126 | | 0.777 | |
| 132 | 0.777 | | |
| 144 | | | 0.777 |
| 156 | 0.777 | | |
| 168 | | 0.777 | |
| 180 | | | 0.777 |
| 192 | | 0.777 | |
| 204 | 0.777 | | |
| 216 | | | 0.777 |
| 228 | 0.777 | | |
| 234 | | 0.777 | |
| 252 | | | 0.777 |
| 270 | | 0.777 | |
| 276 | 0.777 | | |
| 288 | | | 0.777 |
| 300 | 0.777 | | |
| 312 | | 0.777 | |
| 324 | | | 0.777 |
| 336 | 0.777 | | |
| 348 | | 0.777 | |

Fig. 16

401

4001

Distance from nozzle end

Degree disposal about the liner

| degree | 1st col. 3.65" | 2nd col. 4.9" | 3rd col. 6.15" |
|---|---|---|---|
| 0 | | | 1.39 |
| 12 | | 0.71 | |
| 24 | 0.59 | | |
| 36 | | | 0.71 |
| 48 | 0.59 | | |
| 60 | | 0.71 | |
| 72 | | | 1.39 |
| 84 | 0.59 | | |
| 90 | | 0.71 | |
| 108 | | | 0.71 |
| 126 | | 0.71 | |
| 132 | 0.59 | | |
| 144 | | | 1.39 |
| 156 | 0.59 | | |
| 168 | | 0.71 | |
| 180 | | | 0.71 |
| 192 | | 0.71 | |
| 204 | 0.59 | | |
| 216 | | | 1.39 |
| 228 | 0.59 | | |
| 234 | | 0.71 | |
| 252 | | | 0.71 |
| 270 | | 0.71 | |
| 276 | 0.59 | | |
| 288 | | | 1.39 |
| 300 | 0.59 | | |
| 312 | | 0.71 | |
| 324 | | | 0.71 |
| 336 | 0.59 | | |
| 348 | | 0.71 | |

Fig. 17

501

5001

Distance from nozzle end

Degree disposal about the liner

| degree | 1st col. 5.14" | 2nd col. 6.39" | 3rd col. 7.64" |
|---|---|---|---|
| 0 | 0.784 | | 0.912 |
| 20 | | 0.85 | |
| 30 | 0.784 | | 0.912 |
| 40 | | 0.85 | |
| 60 | 0.784 | | 0.912 |
| 80 | | 0.85 | |
| 90 | 0.784 | | 0.912 |
| 100 | | 0.85 | |
| 120 | 0.784 | | 0.912 |
| 140 | | 0.85 | |
| 150 | 0.784 | | 0.912 |
| 160 | | 0.85 | |
| 180 | 0.784 | | 0.912 |
| 200 | | 0.85 | |
| 210 | 0.784 | | 0.912 |
| 220 | | 0.85 | |
| 240 | 0.784 | | 0.912 |
| 260 | | 0.85 | |
| 270 | 0.784 | | 0.912 |
| 280 | | 0.85 | |
| 300 | 0.784 | | 0.912 |
| 320 | | 0.85 | |
| 330 | 0.784 | | 0.912 |
| 340 | | 0.85 | |

Fig. 18

601

6001

Distance from nozzle end

Degree disposal about the liner

| degree | 1st col. 5.14" | 2nd col. 6.39" | 3rd col. 7.64" |
|---|---|---|---|
| 0 | 0.912 | | 0.784 |
| 20 | | 0.85 | |
| 30 | 0.912 | | 0.784 |
| 40 | | 0.85 | |
| 60 | 0.912 | | 0.784 |
| 80 | | 0.85 | |
| 90 | 0.912 | | 0.784 |
| 100 | | 0.85 | |
| 120 | 0.912 | | 0.784 |
| 140 | | 0.85 | |
| 150 | 0.912 | | 0.784 |
| 160 | | 0.85 | |
| 180 | 0.912 | | 0.784 |
| 200 | | 0.85 | |
| 210 | 0.912 | | 0.784 |
| 220 | | 0.85 | |
| 240 | 0.912 | | 0.784 |
| 260 | | 0.85 | |
| 270 | 0.912 | | 0.784 |
| 280 | | 0.85 | |
| 300 | 0.912 | | 0.784 |
| 320 | | 0.85 | |
| 330 | 0.912 | | 0.784 |
| 340 | | 0.85 | |
| | | | |

Fig. 19

701

7001

Distance from nozzle end degree disposal about the liner

| degree | 1st col. 5.14" | 2nd col. 6.39" | 3rd col. 7.64" |
|---|---|---|---|
| 0 | 0.85 | | 0.85 |
| 20 | | 0.85 | |
| 30 | 0.85 | | 0.85 |
| 40 | | 0.85 | |
| 60 | 0.85 | | 0.85 |
| 80 | | 0.85 | |
| 90 | 0.85 | | 0.85 |
| 100 | | 0.85 | |
| 120 | 0.85 | | 0.85 |
| 140 | | 0.85 | |
| 150 | 0.85 | | 0.85 |
| 160 | | 0.85 | |
| 180 | 0.85 | | 0.85 |
| 200 | | 0.85 | |
| 210 | 0.85 | | 0.85 |
| 220 | | 0.85 | |
| 240 | 0.85 | | 0.85 |
| 260 | | 0.85 | |
| 270 | 0.85 | | 0.85 |
| 280 | | 0.85 | |
| 300 | 0.85 | | 0.85 |
| 320 | | 0.85 | |
| 330 | 0.85 | | 0.85 |
| 340 | | 0.85 | |

Fig. 20

801

8001

Distance from nozzle end

Degree disposal about the liner

| degree | 1st col. 5.14" | 2nd col. 6.39" | 3rd col. 7.64" |
|---|---|---|---|
| 0 | 0.784 | | 0.784 |
| 20 | | 0.85 | |
| 30 | 0.912 | | 0.912 |
| 40 | | 0.85 | |
| 60 | 0.784 | | 0.784 |
| 80 | | 0.85 | |
| 90 | 0.912 | | 0.912 |
| 100 | | 0.85 | |
| 120 | 0.784 | | 0.784 |
| 140 | | 0.85 | |
| 150 | 0.912 | | 0.912 |
| 160 | | 0.85 | |
| 180 | 0.784 | | 0.784 |
| 200 | | 0.85 | |
| 210 | 0.912 | | 0.912 |
| 220 | | 0.85 | |
| 240 | 0.784 | | 0.784 |
| 260 | | 0.85 | |
| 270 | 0.912 | | 0.912 |
| 280 | | 0.85 | |
| 300 | 0.784 | | 0.784 |
| 320 | | 0.85 | |
| 330 | 0.912 | | 0.912 |
| 340 | | 0.85 | |
| | | | |

Fig. 22

901

9001

Distance from nozzle end

Degree disposal about the liner

| degree | 1st col. 4.75" | 2nd col. 6.39" | 3rd col. 8.15" |
|---|---|---|---|
| 0 | 0.784 | | 0.784 |
| 20 | | 0.85 | |
| 30 | 0.912 | | 0.912 |
| 40 | | 0.85 | |
| 60 | 0.784 | | 0.784 |
| 80 | | 0.85 | |
| 90 | 0.912 | | 0.912 |
| 100 | | 0.85 | |
| 120 | 0.784 | | 0.784 |
| 140 | | 0.85 | |
| 150 | 0.912 | | 0.912 |
| 160 | | 0.85 | |
| 180 | 0.784 | | 0.784 |
| 200 | | 0.85 | |
| 210 | 0.912 | | 0.912 |
| 220 | | 0.85 | |
| 240 | 0.784 | | 0.784 |
| 260 | | 0.85 | |
| 270 | 0.912 | | 0.912 |
| 280 | | 0.85 | |
| 300 | 0.784 | | 0.784 |
| 320 | | 0.85 | |
| 330 | 0.912 | | 0.912 |
| 340 | | 0.85 | |

Fig. 23

LOW EMISSIONS GAS TURBINE COMBUSTOR

CROSS REFERENCE TO RELATED APPLICATION

This application is a continuation-in-part (CIP) of the following application Ser. No. 11/531,045, filed Sep. 12, 2006 now U.S. Pat. No. 7,887,322; Ser. No. 11/418,239 filed May 4, 2006; Ser. No. 12/219,534 filed Jul. 23, 2008, entitled "Gas Turbine Transition Piece Having Dilution Holes"; and Ser. No. 12/180,879 filed Jul. 28, 2008, (entitled "Centerbody Cap for a Turbomachine Combustor and Method).

FIELD OF THE INVENTION

The invention described herein relates to a combination of gas turbine combustor components that is capable of reducing $NO_x$ emissions to less than 5 ppm.

This disclosure relates to a gas turbine combustor with improved emissions performance and stability.

BACKGROUND OF THE INVENTION

Gas turbines comprise a compressor for compressing air, a combustor for producing a hot gas by mixing fuel and air and burning the resulting mixture, and a turbine to extract work from the expanding hot gas produced by the combustor. Gas turbine compressors pressurize inlet air which is then reverse flowed to the combustor where it is used to provide air to the combustion process. Each combustion chamber assembly comprises a cylindrical combustor liner, a fuel injection system, and a transition piece that guides the flow of the hot air from the combustor liner to the entrance of the turbine section.

Gas turbines are known to emit various undesirable oxides, such as nitrogen oxide (NOx), carbon monoxide (CO), as well as unburned hydrocarbons. It is well known that both oxidation of molecular nitrogen and oxidation of carbon monoxide to carbon dioxide depend on the temperature of the hot gas which is produced inside the turbine combustor and then flows through the transition piece to the turbine section. In addition, the residence time of the reactants in the combustor at these high temperatures is also a factor in producing undesirable emissions. To improve the performance of the combustor with respect to emissions, gas temperatures have to be high enough for an adequate period of time to oxidize carbon monoxide without being so high that excessive amounts of nitrogen oxides are produced.

Existing dry low NOx combustors (DLN combustors) minimize the generation of NOx, CO and other pollutants. These DLN combustors provide a fuel-lean mixture of fuel and air prior to combustion. Dilution air is provided to the combustor liner to absorb heat and reduce the temperature rise to a level where thermal NOx is not formed. Dilution air may also be provided to the transition piece between the combustor and the first stage nozzle. However, in many cases, even combustors with lean premixed fuel and air still achieve sufficiently high temperatures to produce undesirable emissions.

NOx emissions requirements are becoming more stringent Accordingly, there is a need for a lower NOx emission combustor that utilizes various ways to control the influx and movement of air in the combustor as well as to effect independent and variable control of fuel flow to fuel introduction locations of the combustor.

BRIEF DESCRIPTION OF THE INVENTION

The invention described herein relates to a gas turbine combustor comprising: a primary combustion chamber; a secondary combustion chamber downstream of the primary combustion chamber; a venturi connecting the primary and secondary combustion chambers, the venturi having a venturi throat; a transition piece connected to a downstream end of the secondary combustion chamber for confining a flow of combustion products from the combustor to a turbine first stage nozzle; a cap assembly attached to the primary combustion chamber, the cap assembly comprising a centerbody having a first end and a second end, and an external turbulator member in operable communication with the cap assembly and being spaced from a wall of the centerbody to form a gap that defines a passage, wherein the primary combustion chamber includes a mixing hole arrangement for improving homogeneity of an air and fuel mixture in the combustor, the mixing hole arrangement including a plurality of mixing holes in a liner of the primary combustion chamber at least one of which is a mixing hole that is sized and positioned so that to impede a fluid flow penetration into a primary mixing zone located at the upstream end of the combustor; the venturi throat is disposed within a predetermined distance upstream from the downstream end of the primary combustion chamber; the transition piece is composed of a duct body, with a plurality of dilution holes formed in the duct body, the dilution holes located at selected X, Y and Z coordinates measured from a zero reference point at a center of an exit plane of the transition piece, and the external turbulator member including a step positioned at the second end of the centerbody, the step defining a radial distance about the second end of the centerbody, wherein the external turbulator is formed having a step-to-gap ratio relative to the centerbody in a range of about 0.8 to about 1.2.

In another aspect, a method for achieving NOx emissions of less than 5 ppm in a gas turbine combustor, the combustor including a primary combustion chamber, a secondary combustion chamber downstream of the primary combustion chamber, a venturi connecting the primary and secondary combustion chambers, the venturi having a venturi throat, a transition piece connected to a downstream end of the secondary combustion chamber for confining a flow of combustion products from the combustor to a turbine first stage nozzle, and a cap assembly attached to the primary combustion chamber and having a centerbody, the method comprising: impeding a fluid flow penetration from a mixing hole of the primary combustion chamber into at least one of a fuel flow and a primary mixing zone of the combustor; expanding an annular fluid flow and a center fluid flow by disposing the venturi throat a predetermined distance upstream from the downstream end of the primary combustion chamber; forming a plurality of dilution holes in the duct body of the transition piece, the dilution holes located at selected X, Y and Z coordinates measured from a zero reference point at a center of an exit plane of the transition piece; and guiding a cooling airflow through a passage defined by a gap extending between a wall of the centerbody and a turbulator member having a step portion, the turbulator member formed having a step-to-gap ratio relative to the centerbody of between about 0.8 and 1.2, the step-to-gap ratio enhancing air/fuel mixing and reducing an amount of the cooling airflow required by the combustor.

BRIEF DESCRIPTION OF THE DRAWINGS

FIG. 15 shows a Table representing a mixing hole arrangement 2001 in a head end portion of a liner of a combustor.

FIG. 16 shows a Table representing a mixing hole arrangement 3001 in a head end portion of a liner of a combustor.

FIG. 17 shows a Table representing a mixing hole arrangement 4001 in a head end portion of a liner of a combustor.

FIG. 18 shows a Table representing a mixing hole arrangement 5001 in a head end portion of a liner of a combustor.

FIG. 19 shows a Table representing a mixing hole arrangement 6001 in a head end portion of a liner of a combustor.

FIG. 20 shows a Table representing a mixing hole arrangement 7001 in a head end portion of a liner of a combustor.

FIG. 22 shows a Table representing a mixing hole arrangement 8001 in a head end portion of a liner of a combustor.

FIG. 23 shows a Table representing a mixing hole arrangement 9001 in a head end portion of a liner of a combustor.

DETAILED DESCRIPTION OF THE INVENTION

Figure 1:
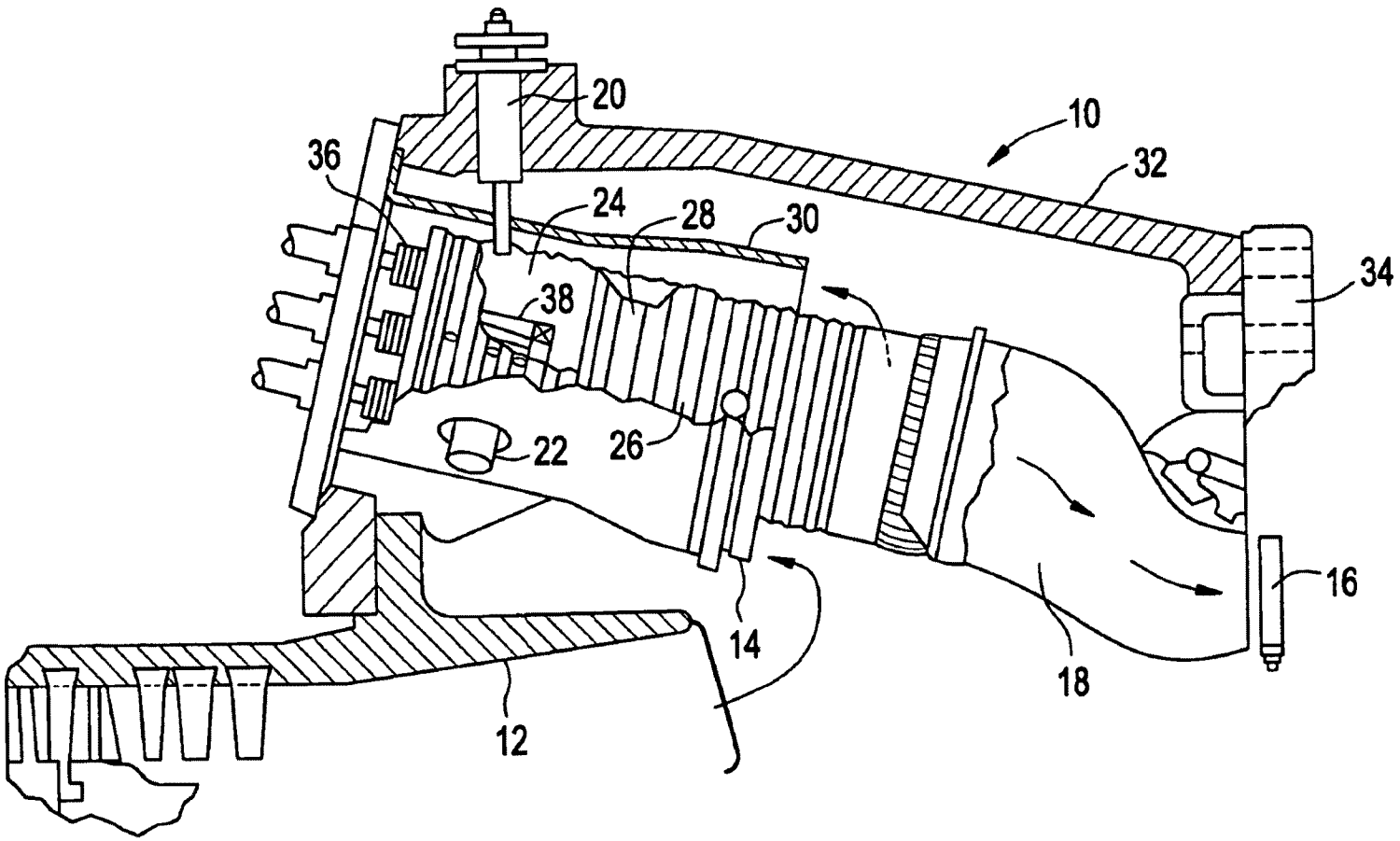
FIG. 1 shows a partial cross section view of a gas turbine for use in accordance with an exemplary embodiment.

Referring now to the drawings and particularly to FIG. 1, a gas turbine 10 (partially shown) includes a compressor 12 (partially shown), a combustor 14, and a turbine section represented here by a single blade 16. The compressor 12 pressurizes inlet air and reverse-flows it to the combustor 14 where it is used to cool the combustor and to provide air for the combustion process. The combustor may be one of several arranged in a "can-annular" array about the turbine rotor, each supplying gas to the first stage turbine nozzle.

A transition piece 18 connects the downstream end of the combustor with the inlet end of the turbine to deliver the hot products of combustion to the turbine.

The combustor 14 may comprise an upstream combustion chamber 24 and a downstream combustion chamber 26 connected with each other via a venturi throat region 28. The combustor 14 is surrounded by a combustor flow sleeve 30 which channels compressor discharge air flow to the combustor 14. An outer casing 32 which is bolted to a turbine casing 34 surrounds the combustor 14.

Fuel is provided to the combustor 14 via primary nozzles 36 arranged in an annular array around a secondary nozzle 38. The primary nozzles 36 provide fuel to the upstream combustor 24 and the secondary nozzle 38 provides fuel to the downstream combustion chamber 26. A sparkplug 20 is used to provide ignition to the various combustors 14 in conjunction with crossfire tubes 22 (one shown).

Figure 2:
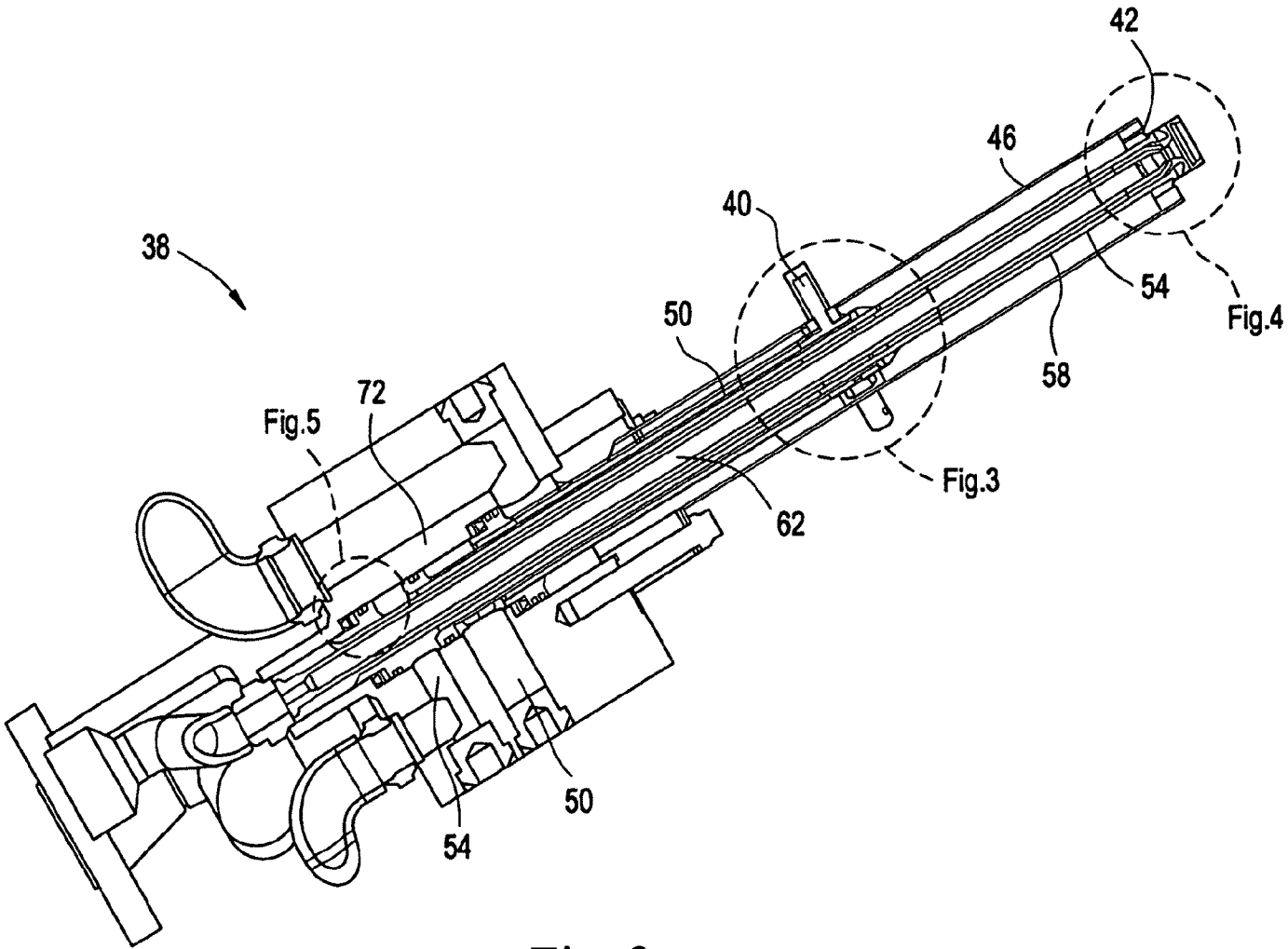
FIG. 2 shows a side view of an exemplary secondary nozzle for use in accordance with an exemplary embodiment.

In an exemplary embodiment, shown in FIG. 2, the secondary nozzle may be a nozzle as disclosed in U.S. 2007/0130955 A1. This nozzle comprises two fuel introduction locations, e.g., secondary nozzle pegs 40 and a secondary nozzle pilot tip 42. The secondary nozzle pegs 40 provide fuel to a pre-mix reaction zone of the combustor 14, while the secondary nozzle pilot tip 42 provides fuel to the downstream combustion chamber 26 where it is immediately burned (diffusion combustion).

With the above arrangement, the secondary nozzle 38 comprises a combustion system fuel delivery section having separate and individually controlled fuel circuits. This allows for the ability to individually vary fuel flow rates delivered to the two fuel introduction locations of the secondary nozzle. For example, the fuel flow rate through the secondary nozzle pilot tip 42 may be varied independently from the fuel flow rate through the secondary nozzle pegs 40. Furthermore, the secondary nozzle pegs 40 and the secondary nozzle pilot tip 42 each have their own independent fuel piping circuit, each having independent and exclusive fuel sources.

In an exemplary embodiment, the fuel flow rate delivered through the secondary nozzle pilot tip 42 is less than about 2% of the total gas turbine fuel flow, and is in the range of about 0.002 pps (pounds per second) to about 0.020 pps.

The ability to control the amount of fuel flow to different regions of the combustor allows for the minimizing of NOx and Co emissions for a given set of operating conditions. In particular, the independent control of the two fuel introduction locations may achieve sub-5 ppm (parts per million) NOx emissions across the full ambient and load range.

Figure 3:
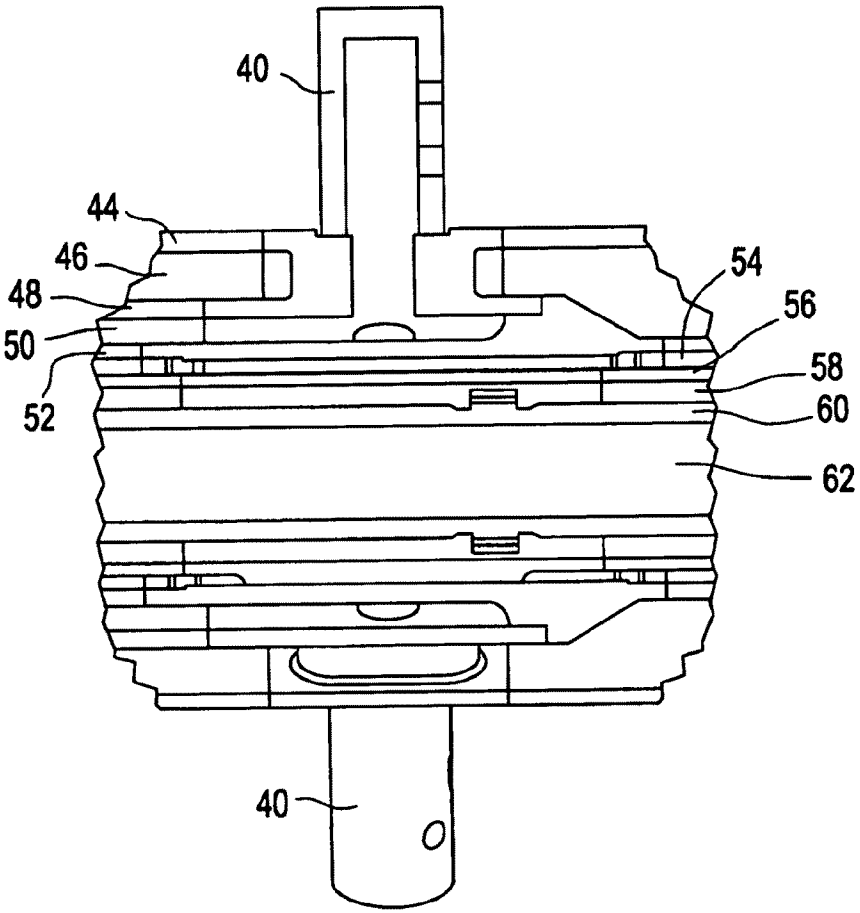
FIG. 3 shows an enlarged view of a secondary nozzle peg area of the secondary nozzle of FIG. 2.

The secondary nozzle pegs 40 are shown in FIG. 3 along with the independent fuel circuits and passages. The secondary fuel nozzle 38 comprises a plurality of concentric tubes. The two radially outermost concentric tubes 44 and 48 provide a tertiary gas passage 46. providing tertiary gas to the secondary nozzle pilot tip 42.

A secondary gas fuel passage 50, formed between concentric tubes 48 and 52 supplies secondary gas fuel to the secondary pegs 40. In addition, a sub-pilot gas fuel passage 54 formed between concentric tubes 52 and 56 supplies fuel to the secondary nozzle pilot tip 42.

A water purge passage 58 defined between concentric tubes 56 and 60 provides water to the secondary nozzle pilot tip 42 to effect NOx and CO emission reductions. Moreover, a liquid fuel passage 62 comprising the innermost of the plurality of concentric passages forming the secondary nozzle 38 and defined by tube 60, provides liquid fuel to the secondary nozzle pilot tip 42.

Even though four independent fuel circuits are shown in FIG. 2, the number of fuel circuits may be varied according to specific operational and design considerations.

Figure 4:
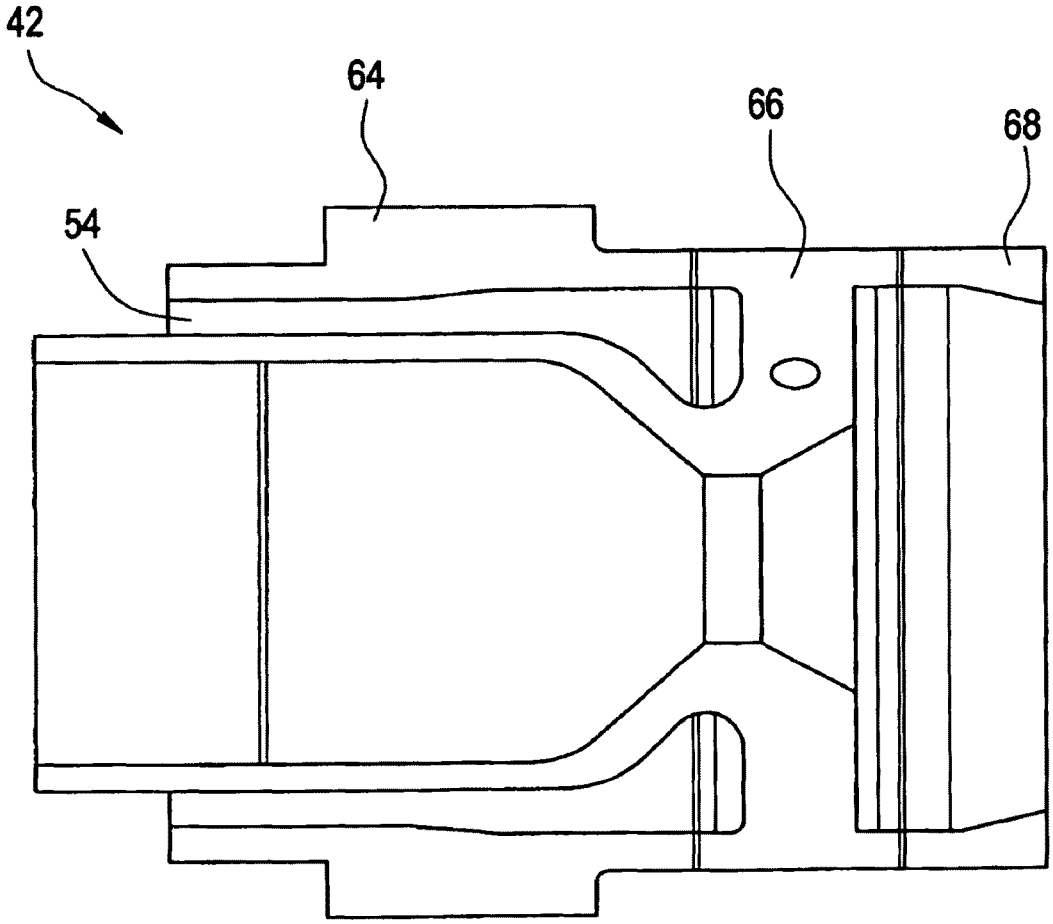
FIG. 4 shows an enlarged view of a secondary nozzle pilot tip of the secondary nozzle of FIG. 2.

The secondary nozzle pilot tip 42 is shown in FIG. 4. In one embodiment, it may comprise a three-piece assembly, having a sub-pilot portion 64 (containing the sub-pilot gas fuel at the secondary nozzle pilot tip 42 and abutting tube 52), a water purge portion 66 (containing the water at the secondary nozzle pilot tip 42 and abutting tube 56), and a tip portion 68 (forming an outlet end to the secondary nozzle 38). The three pieces may be fixedly joined, for example, by an electron beam welding process.

Figure 5:
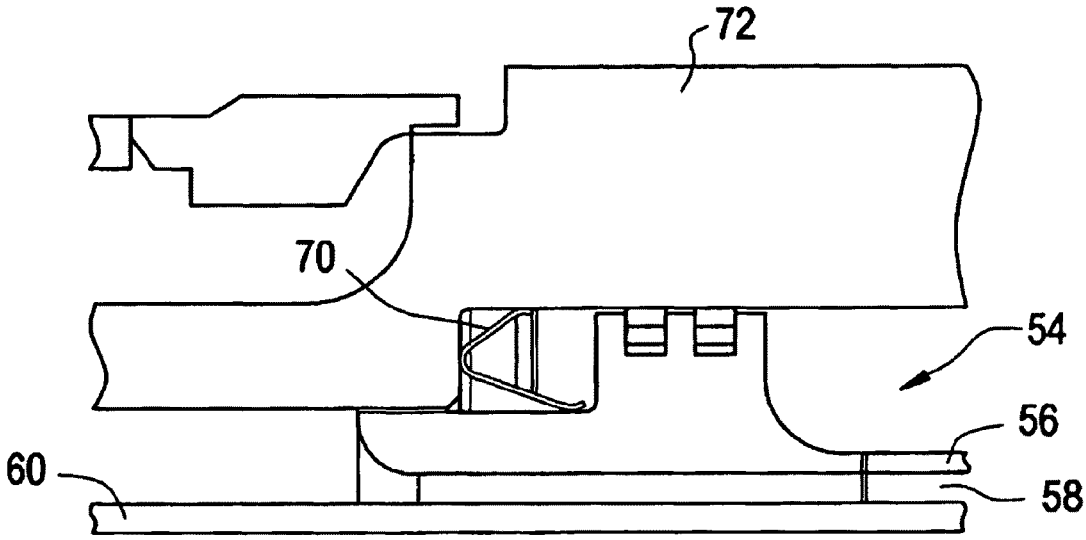
FIG. 5 shows and enlarged view of a lip seal region of the secondary nozzle of FIG. 2.

FIG. 5 shows a lip seal 70 between tube 56 and a secondary nozzle base 72. The lip seal 70 prevents fuel leakage within the secondary nozzle 38 by forming a controlled interference fit between the tube 56 and the secondary nozzle base.

In the exemplary embodiment described above, the emission of undesirable oxide pollutants is reduced by independently controlling the delivery of fuel to the various portions of the combustor chamber. Controlling the air fuel mixture in the combustor also allows for a decrease in undesirable emissions.

Figure 6:
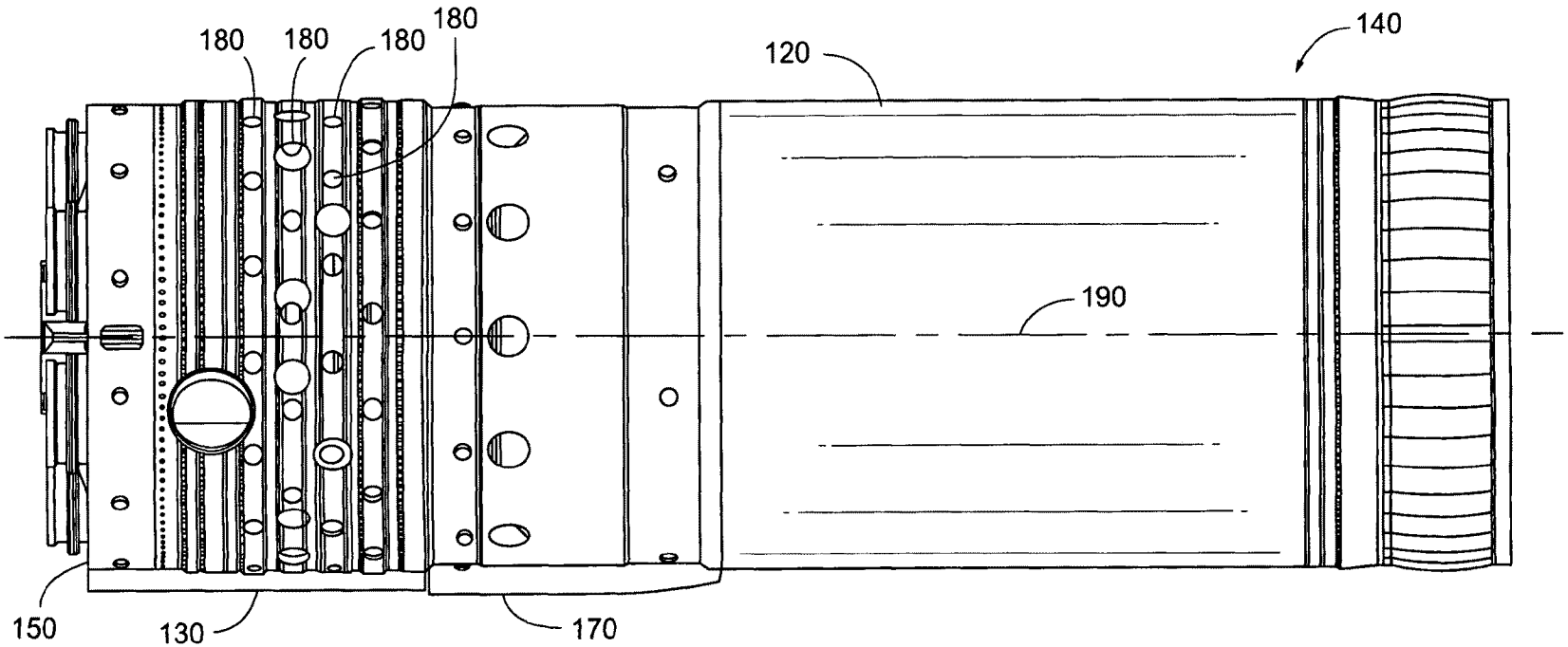
FIG. 6 shows a side view of a liner of a combustor according to an embodiment.
Figure 7:
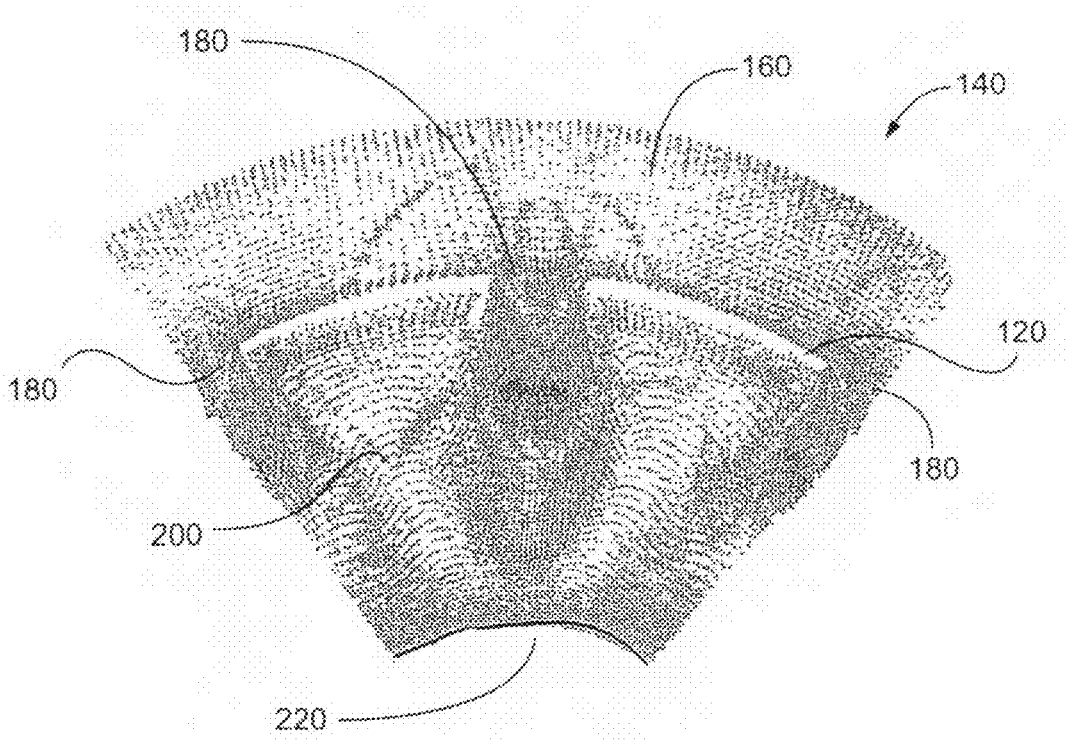
FIG. 7 shows a transverse partial section of the combustor of FIG. 6.

A mixing hole arrangement incorporated with the upstream combustor chamber is shown in FIG. 6. The combustor liner 120 includes a head end 130 of a dry low NOx combustor 140. The combustor 140 includes a primary nozzle end 150 and a venturi throat 170, between which the head end 130 is disposed. The liner 120 included in this head end 130 of the combustor 140 defines a plurality of mixing holes 180 disposed circumferentially around the liner 120. Hole spacing is measured in angles (i.e. 24 degrees between two holes 180) relative to a longitudinal central axis 190 of the combustor 14. The holes 180 allow air flowing through a flow sleeve 160 to penetrate into a primary mixing zone 200, through which the longitudinal central axis 190 runs. Once in the primary mixing zone 200, the air mixes with fuel to facilitate combustion. As shown in FIG. 7, the primary mixing zone 200 is disposed within the combustor 140, radially between the liner 120 and a center-body tube 220 and axially between the primary nozzle end 150 and the venturi throat 170.

Figure 8:
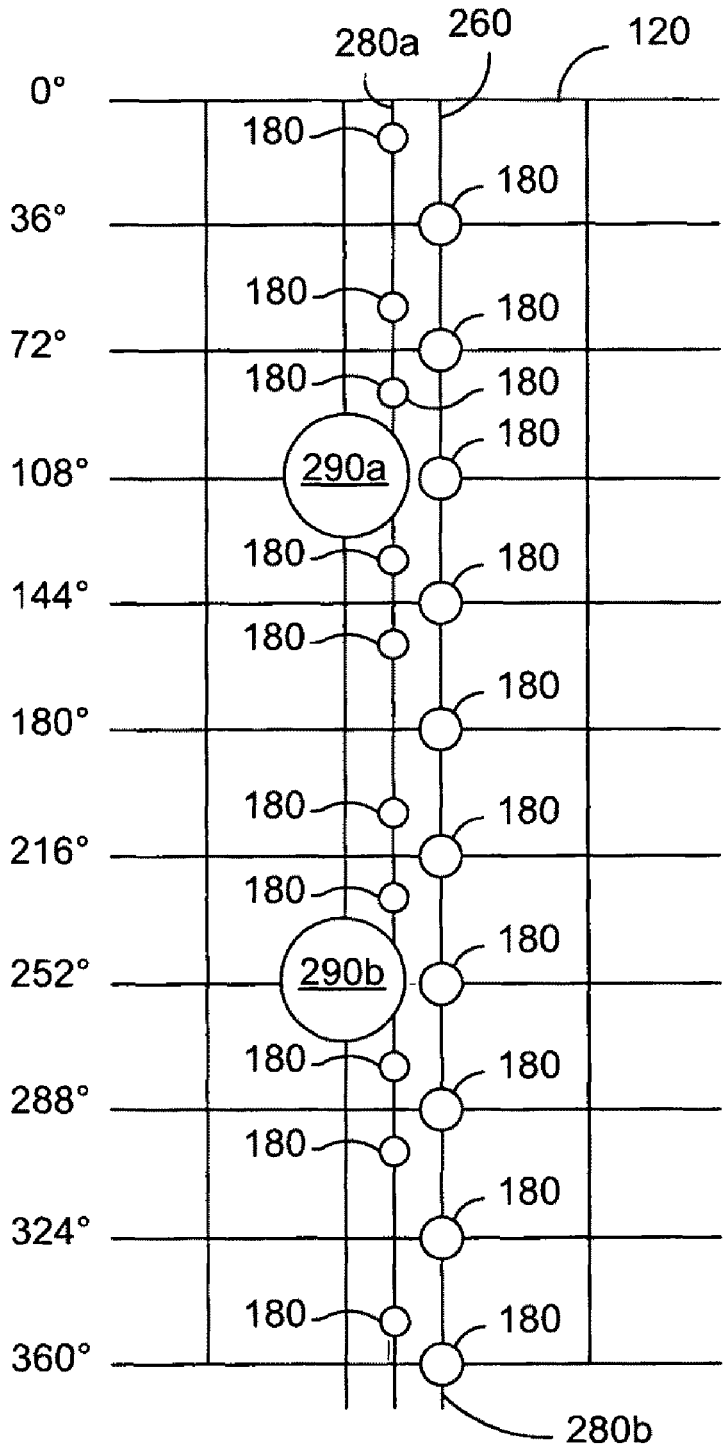
FIG. 8 shows a schematic view of a liner of a 35 megawatt combustor that is illustrated substantially flatly.

The liner 120 referred to above can be found in combustors producing varying amounts of power. Referring to FIG. 8, the liner 120 for the combustor 140 of a 35 megawatt combustion turbine is illustrated (the illustration is flat, though in application the mixing holes 180 are disposed radially about the liner 120, which is in a cylindrical construction), and includes an arrangement 260 of mixing holes 180 sized and positioned for allowing airflow into the primary mixing zone 200. These mixing holes 180 are disposed in two rows (a first row 280*a* and a second row 280*b*) of ten mixing holes 180 each. The first row 280*a* is typically located 4.9 inches from the primary nozzle end 150 shown in FIG. 6, and includes mixing holes 180 that are 0.77 inches in diameter and alternatively positioned at distances of 24 and 48 degrees from each other around the cylindrical liner 120 (i.e. the mixing holes 180 are positioned in a pattern of 24-48-24-48 degrees from each other around the liner 12). The second row 280*b* is located 6.15 inches from the primary nozzle end 150, and includes mixing holes 180 that are 1.04 inches in diameter and positioned at distances of 36 degrees from each other around the liner 120. Two cross-fire tubes 290*a-b* are also illustrated between the first row 280*a* and the primary nozzle end 150.

Figure 9:
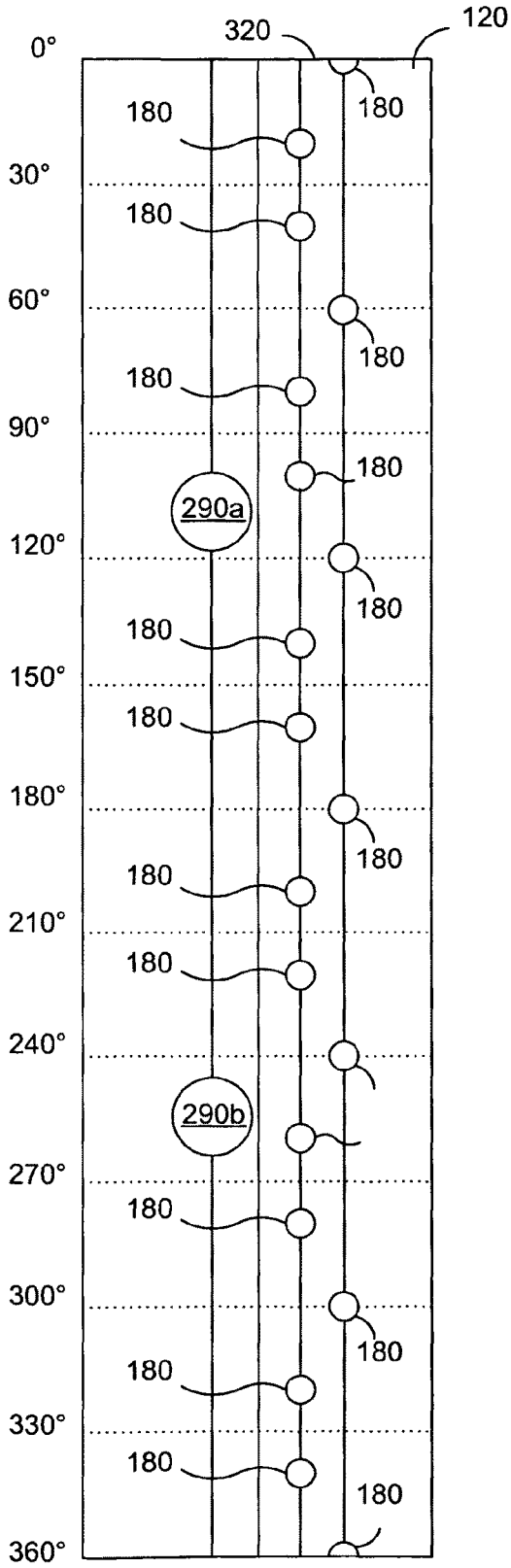
FIG. 9 shows a schematic view of a liner of an 80 megawatt combustor that is illustrated substantially flatly.

Referring to FIG. 9, the liner 120 for the combustor 140 of an 80 megawatt combustion turbine is illustrated (the illustration is flat, though in application the mixing holes 180 are disposed circumferentially about the liner 120, which is in a cylindrical construction) and includes an arrangement 320 of mixing holes 180 sized and positioned for allowing airflow into the primary mixing zone 200. These mixing holes 180 are disposed in two rows (a first row 340*a* and a second row 340*b*) of twelve (340*a*) and six (340*b*) mixing holes 180, respectively. The first row 340*a* is located 6.39 inches from the primary nozzle end 150 shown in FIG. 6, and includes mixing holes 180 of that are 1.125 inches in diameter and alternatively positioned at distances of 20 and 40 degrees from each other around the cylindrical liner 120 (i.e. the mixing holes 180 are positioned in a pattern of 20-40-20-40 degrees from each other around the liner 120). The second row 340*b* is located 7.64 inches from the primary nozzle end 150, and also includes mixing holes 180 that are 1.125 inches in diameter. However, the mixing holes 180 in the second row 340*b* are positioned consistently at distances of 60 degrees from each other around the liner 12. Two cross-fire tubes 290*a-b* like those mentioned above are additionally illustrated at the left of the first row 340*a*.

Figure 10:
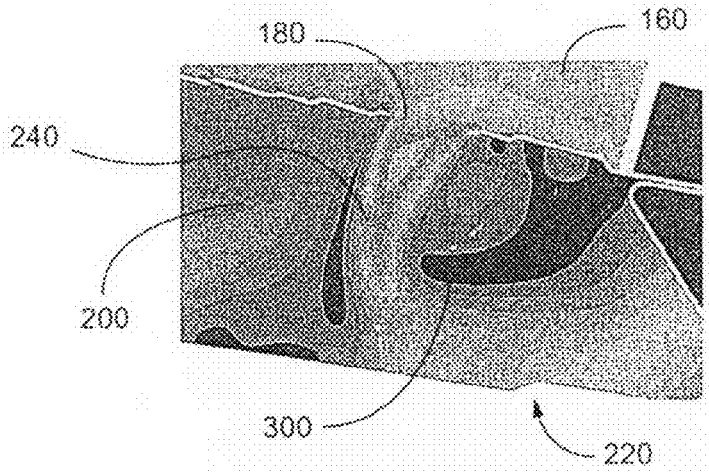
FIG. 10 shows a representation of flow pattern into a primary mixing chamber.
Figure 11:
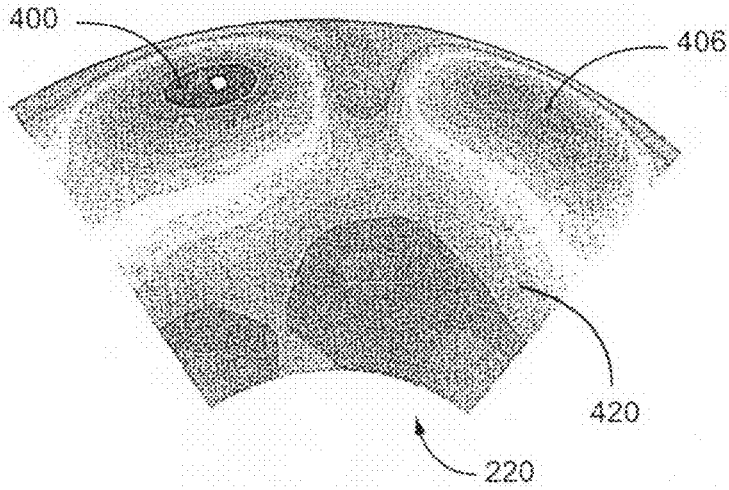
FIG. 11 shows a representation of a fuel concentration in the primary mixing chamber.

Mixing hole 180 arrangements like arrangements 260 and 320 typically result in a fluid flow 240 (which may be air) from the flow sleeve 160, through the mixing holes 180, and radially into the primary mixing zone 200, as shown in FIG. 10. The fluid flow 240 enters the primary mixing zone 200 roughly orthogonally to a direction of a fuel flow 300 introduced into the mixing zone 200. Because of a velocity of fluid flow 240, that flow 240 penetrates the fuel flow 300 to a depth sufficient to impact the center-body tube 220. Due to the impact of the fluid flow 240 against the center-body 220, this fluid flow 240 "splashes" off of the center-body tube 220, resulting in a pocketed, heterogeneous air and fuel mixture 380 like that which is shown in FIG. 11. In FIG. 11, the darker regions represent pockets of fuel 4000*a-b* that have been pushed away from the center-body tube 220 by the splashing fluid flow 240.

Figure 12:
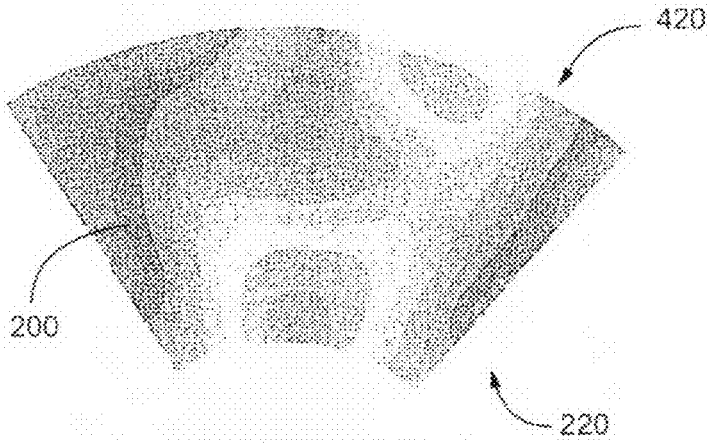
FIG. 12 is a representation of fuel concentration in the primary mixing chamber according to one aspect of an exemplary embodiment.
Figure 13:
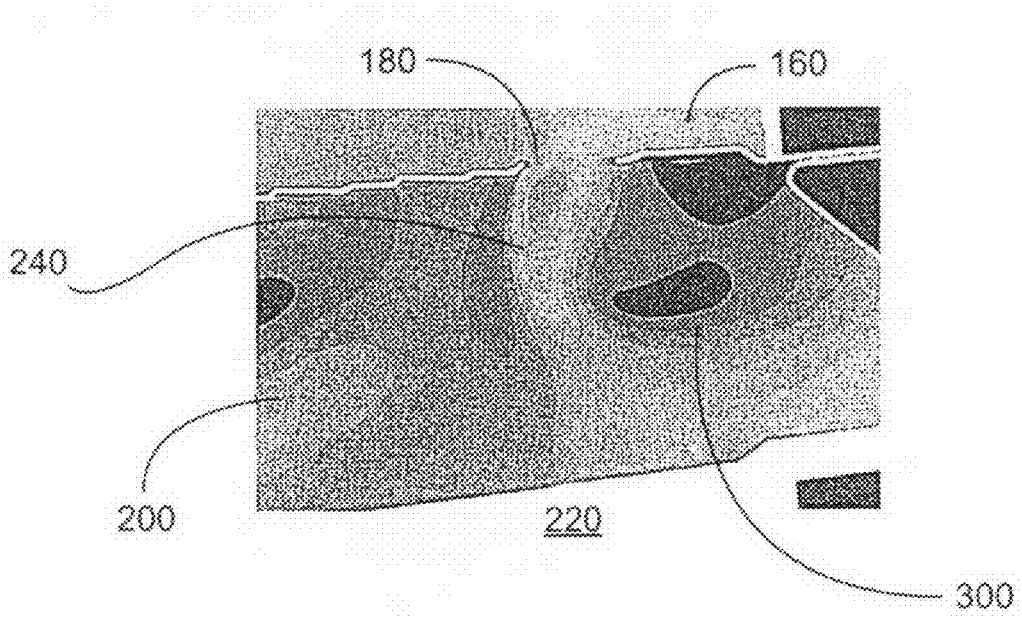
FIG. 13 is a representation of flow pattern into the primary mixing chamber according to one aspect of an exemplary embodiment.

Referring now to FIG. 12, a less heterogeneous air and fuel mixture 420 is illustrated. In FIG. 12, fuel pocketing has been reduced as compared with the fuel pocketing of FIG. 11. This less heterogeneous mixture 420 achieves improved NOx emissions in combustors such as dry low NOx combustors, like the one partially illustrated in of FIGS. 6 and 7. This homogeneity can be achieved by impeding penetration of the fluid flow 240 into the primary mixing zone 200 during combustor operation, as shown in FIG. 13. In FIG. 13, penetration of the fluid flow 240 into the fuel flow 300 is reduced (impeded) compared with the mixing of FIG. 10 (which results from hole arrangements 260 and 320) reducing splash of the fluid flow 240 off the center-body tube 220. Penetration of the fluid flow 240 into the primary mixing zone 300 can be represented as a percentage of the distance between the liner 120 and the centerbody 220. Anything over 100% would be a condition where the fluid flow splashes off the centerbody with 200% representing a much stronger splash than, for example 125%. The penetration is calculated using standard correlations for a jet (fluid flow 240) penetrating into crossflow, a standard correlation being $Y_{max}/D_j$=sqrt(Momentum of Jet/Momentum of crossflow)*$C_1$ (where $Y_{max}$=Max jet penetration, $D_j$=Jet diameter, Momentum of Jet=$0.5*\rho_j*V_j^2$, Momentum of Cross-flow=$0.5*\rho_{cf}*V_{cf}^2$, $C_1$=1.15 for these calculations, $\rho_j$=Density of jet fluid, $\rho_{cf}$=Density of cross-flow fluid, $V_j$=Jet Velocity, and $V_{cf}$=Cross flow velocity). Fluid flow 240 penetrating than about 195% or more into the primary mixing zone 200 can lead to a heterogeneous air-fuel mixture that creates undesirably high emissions. In FIG. 13, the fluid flow 240 penetrates less than or equal to about 165% into the primary mixing zone 20, with an exemplary range of between about 100% and 165%. The exemplary range optimizes a balance between decreasing emissions and maintaining stability.

Figure 14:
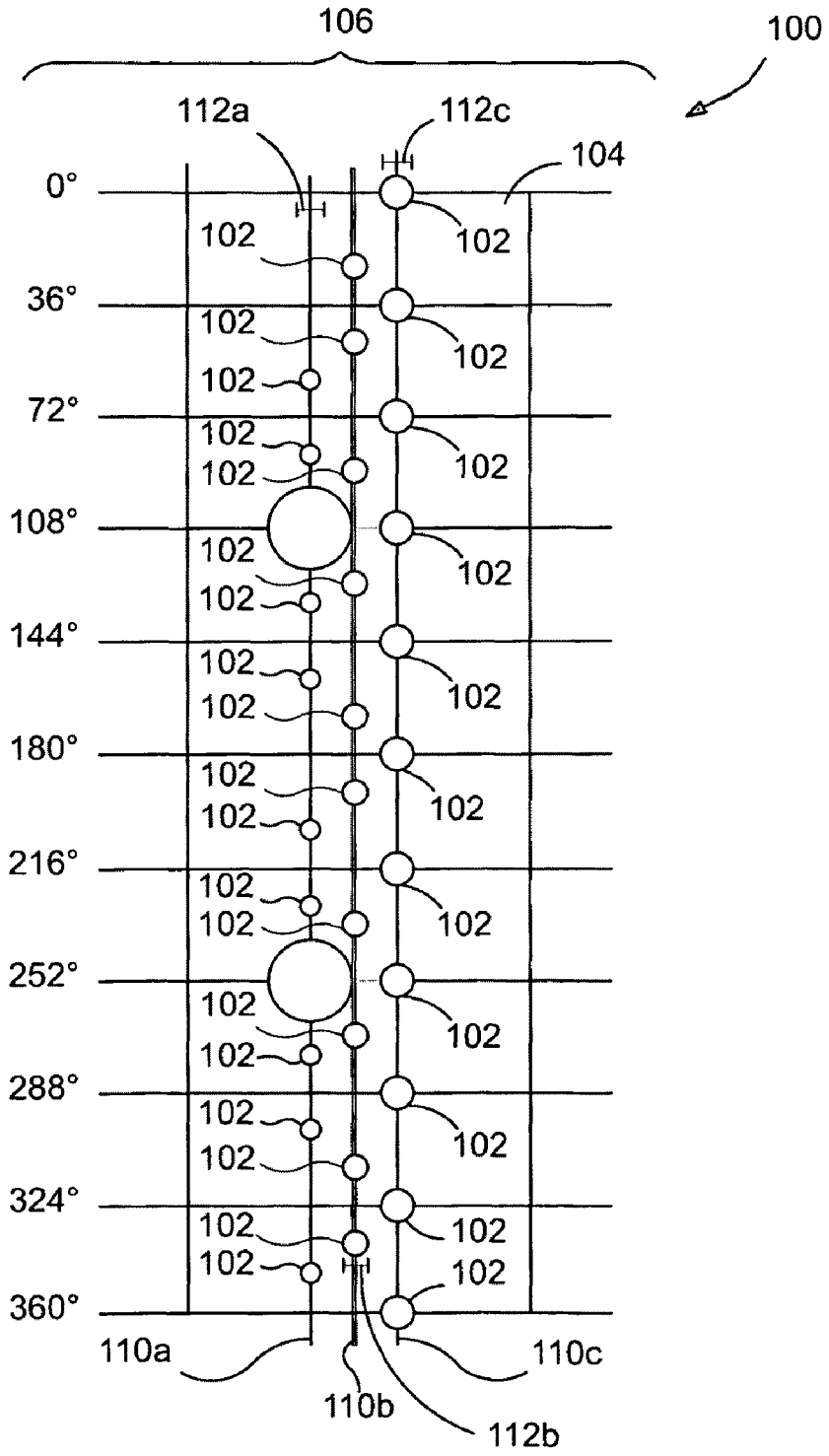
FIG. 14 shows a schematic view of a head end portion of a liner of a combustor that is illustrated substantially flatly and in accordance with an exemplary embodiment of a mixing hole arrangement 100.

Referring to FIG. 14, an exemplary embodiment of a mixing hole arrangement 100 that will allow for the improved less heterogeneous air and fuel mixture 420 shown in FIG. 12 is illustrated. This arrangement 100 impedes penetration of the fluid flow 240 into the fuel flow 300 and primary mixing zone 200, allowing for the homogeneous mixture 240. Impeding the fluid flow 240, as shown in FIG. 13, via this arrangement 100 causes the fluid flow 240 to penetrate less than or equal to about 165% into the primary mixing zone 200, with an exemplary range of between about 150% and 165%, as was mentioned above. The arrangement 100 comprises a plurality of mixing holes 102 defined by a liner 104 (the illustration is flat, though in application the mixing holes 102 are disposed radially about the liner 104, which is cylindrical in construction) of the head end 106. At least one of this plurality of mixing holes 102 is at least one of sized (diameter) and positioned to impede penetration of the fluid flow 240 into the primary mixing zone 200 shown in FIG. 13.

The combustor 140 in this embodiment is a dry low NOx combustor (like that which is shown in FIG. 6), which may be for a 35 megawatt variety turbine. The mixing holes 102 are arranged in three rows, illustrated as a first row 110*a*, a second row 110*b*, and a third row 110*c*. The mixing holes 102 in at least one of the three rows are sized (diameter) and positioned to impede penetration of the fluid flow 240 into the fuel flow 300 and primary mixing zone 200. In the exemplary embodiment, the mixing holes 102 in the first row 110*a* are positioned to include alternating distances of 24 and 36 degrees between each mixing hole 102 around the liner 104 (i.e. the mixing holes 102 are at 24 degrees, 60 degrees, 84 degrees, 120 degrees, and so on around the liner 104), at a distance of 3.65 inches from the primary nozzle end 150 (illustrated in FIG. 6). These mixing holes 102 also have a diameter 112*a* of 0.59 inches. The mixing holes 102 in the second row 110*b* (in the exemplary embodiment) are positioned at 102 at 12, 60, 90, 126, 168, 192, 234, 270, 312, and 348 degrees around the liner 104, at a distance of 4.9 inches from the primary nozzle end 15. These mixing holes 102 have a diameter 112*b* of 0.71 inches. The mixing holes 102 in the third row 110*c* (also in the exemplary embodiment) are positioned 36 degrees from each other around the liner 104, at a distance of 6.15 inches from the primary nozzle end 15. These mixing holes 102 have a diameter 112*c* of 0.98 inches.

Three rows, the overall decrease in diameter 112*a-c* of the mixing holes 102, and the positioning of the mixing holes 102 are all elements of the arrangement 100 that may impede fluid flow 240 penetration as shown in FIG. 13, and result in the less heterogeneous mixture 420 shown in FIG. 12. It should be appreciated that though these three rows 110*a-c* each include the same number of mixing holes 102 (ten), each individual row may include more or less mixing holes 102. It should also be appreciated that the arrangement 100 is intended to increase homogeneity, but may not be intended to maximize homogeneity of a fluid and fuel mixture. A mixture that is too homogeneous will decrease stability along with decreasing NOx emissions. The arrangement 100 decreases emissions while maintaining a balance between emissions and stability. Striking this balance (i.e. to making a mixture too homogeneous) is one reason why only some of the plurality of mixing holes 102 might be sized and positioned to impede fluid flow 24 penetration into the primary mixing zone 20.

Referring to FIG. 15, an exemplary embodiment of a mixing hole arrangement 2001 that will allow for the improved less heterogeneous air and fuel mixture 420 shown in FIG. 12 is illustrated. FIG. 15 illustrates a table 201 that represents positioning of the mixing hole arrangement 2001 in a liner like liner 104 of FIG. 14. This arrangement 2001 impedes penetration of the fluid flow 240 into the fuel flow 300 and primary mixing zone 200, allowing for the homogeneous mixture 420. The arrangement 2001 comprises a plurality of mixing holes represented in the table 201 by a measure of diameter disposed in an appropriate row and column. At least one of this plurality of mixing holes in arrangement 2001 is at least one of sized (diameter) and positioned to impede fluid flow 240 penetration into the primary mixing zone 20 shown in FIG. 13.

The combustor 140 in this embodiment is a dry low NOx combustor (like that which is shown in FIG. 6), which may be for a 35 megawatt turbine. The mixing holes of arrangement 2001 are arranged in three rows, illustrated in table 201 as a first column, a second column, and a third column. The mixing holes in at least one of the three rows are sized (diameter) and positioned to impede penetration of the fluid flow 240 into the fuel flow 300 and primary mixing zone 200. In this embodiment, mixing hole diameter decreases as the rows move away from the primary nozzle end 150 (FIG. 6), as opposed to increasing as shown in FIG. 14. The mixing holes of the arrangement 2001 that are disposed in the third row (represented in the third column of the table 201) are positioned to include alternating distances of 24, 36, and 48 degrees between each mixing hole around the circular liner (i.e. the mixing holes 102 are at 24 degrees, 48 degrees, 84 degrees, 132 degrees, 156 degrees and so on around the liner 104), at a distance of 6.15 inches from the primary nozzle end 150 (which is shown in FIG. 6). These mixing holes also have a diameter of 0.59 inches. The mixing holes of the arrangement 2001 in the second row (represented in the second column of the table 201) are positioned at 12, 60, 90, 126, 168, 192, 234, 270, 312, and 348 degrees around the liner, at a distance of 4.9 inches from the primary nozzle end 150. These mixing holes have a diameter of 0.71 inches. The mixing holes of the arrangement 2001 in the first row (represented in the third column of the table 201) are positioned 36 degrees from each other around the liner, at a distance of 3.65 inches from the primary nozzle end 150 (as shown in FIG. 1). These mixing holes have a diameter of 0.98 inches.

Three rows, the overall decrease in diameter of the mixing holes, and the positioning of the mixing holes are all elements of the arrangement 2001 that may impede fluid flow 240 penetration to various levels in the primary mixing zone 200, and result in the less heterogeneous mixture 420 shown in FIG. 12. Impeding the fluid flow 240 via this arrangement 2001 causes the fluid flow 240 to penetrate variously depending on whether the flow is from the holes in the first row second row or third row. Fluid flow 240 from the first row has maximum penetration and penetrates more than or equal to about 250% into the primary mixing zone 200 with an exemplary range between about 250% and 280%. Fluid flow from the second row penetrates less than or equal to about 175% into the primary mixing zone 200, with an exemplary range of between about 130% and 175%, whereas the third row penetrates less than or equal to about 100% into the primary mixing zone 200, with an exemplary range of between about 80% and 100%. It should be appreciated that though the three rows of the arrangement 2001 each include the same number of mixing holes (ten), each individual row may include more or less mixing holes. It should also be appreciated that the arrangement 2001 is intended to increase homogeneity, but may not be intended to maximize homogeneity of a fluid and fuel mixture. A mixture that is too homogeneous will decrease stability along with decreasing NOx emissions. The arrangement 2001 decreases emissions while maintaining a balance between emissions and stability. Striking this balance (i.e. to making a mixture too homogeneous) is one reason why only some of the plurality of mixing holes might be sized and positioned to impede fluid flow 240 penetration into the primary mixing zone 200.

Referring to FIG. 16, an exemplary embodiment of a mixing hole arrangement 3001 that will allow for the improved less heterogeneous air and fuel mixture 420 shown in FIG. 12 is illustrated. FIG. 16 illustrates a table 301 that represents positioning of the mixing hole arrangement 3001 in a liner like liner 104 of FIG. 14. The arrangement 3001 comprises a plurality of mixing holes represented in the table 301 by a measure of diameter disposed in an appropriate row and column. At least one of the plurality of mixing holes of the arrangement 3001 is at least one of sized (diameter) and positioned to impede fluid flow 240 penetration into the primary mixing zone 200 shown in FIG. 13.

The combustor 140 in this embodiment is a dry low NOx combustor (like that which is shown in FIG. 6), which may be for a 35 megawatt turbine. The mixing holes are arranged in three rows, illustrated in table 301 as a first column, a second column, and a third column. The mixing holes in the three rows are sized to impede penetration of the fluid flow 240 into the fuel flow 300 and primary mixing zone 200, with the first column and the second column illustrating rows that are positioned to impede airflow penetration and allow for a less heterogeneous air and fuel mixture 420 (FIG. 12). In this embodiment, mixing hole diameter remains constant throughout all three rows, with each of the mixing holes of the arrangement 3001 having a diameter of 0.777 inches. The mixing holes in the first row (represented in the first column of the table 301) are positioned at 24, 48, 84, 132, 156, 204, 228, 276, 300, and 336 degrees, at a distance of 3.65 inches from the primary nozzle end 150 (as shown in FIG. 6). The mixing holes in the second row (represented in the second column of the table 301) are positioned at 12, 60, 90, 126, 168, 192, 234, 270, 312, and 348 degrees around the circular liner, at a distance of 4.9 inches from the primary nozzle end 150. The mixing holes in the third row (represented in the third column of the table 301) are positioned 36 degrees from each other around the liner, at a distance of 6.15 inches from the primary nozzle end 150.

Three rows, the overall decrease in diameter of the mixing holes in the arrangement 3001, and the positioning of the mixing holes are all elements of the arrangement 3001 that may impede fluid flow 240 penetration, and result in the less heterogeneous mixture 420 shown in FIG. 12. Impeding the fluid flow 240 via this arrangement 3001 causes the fluid flow 240 from the first row to penetrate more than or equal to about 200% into the primary mixing zone 200 with an exemplary range of between about 200% and 220%, fluid flow 240 from the second row to penetrate less than or equal to about 165% into primary mixing zone 200 with an exemplary range of between about 150% and 165% and fluid flow 240 from the third row to penetrate less than or equal to about 130% into the primary mixing zone 200, with an exemplary range of between about 115% and 130% It should be appreciated that though these three rows each include the same number of mixing holes (ten), each individual row may include more or less mixing holes. It should also be appreciated that the arrangement 3001 is intended to increase homogeneity, but may not be intended to maximize homogeneity of a fluid and fuel mixture. A mixture that is too homogeneous will decrease stability along with decreasing NOx emissions. The arrangement 3001 decreases emissions while maintaining a balance between emissions and stability. Striking this balance (i.e. to making a mixture too homogeneous) is one reason why only some of the plurality of mixing holes might be sized and positioned to impede fluid flow 240 penetration into the primary mixing zone 200.

Referring to FIG. 17, an exemplary embodiment of a mixing hole arrangement 4001 that will allow for the improved less heterogeneous air and fuel mixture 420 shown in FIG. 12 is illustrated. FIG. 17 illustrates a table 401 that represents positioning of the mixing hole arrangement 4001 in a liner like liner 104 of FIG. 14. The arrangement 4001 comprises a plurality of mixing holes represented in the table 401 by a measure of diameter disposed in an appropriate row and column. At least one of the plurality of mixing holes of the arrangement 4001 is at least one of sized (diameter) and positioned to impede airflow penetration into the primary mixing zone 200 shown in FIG. 13.

The combustor 140 in this embodiment is a dry low NOx combustor (like that which is shown in FIG. 6), which may be for a 35 megawatt turbine. The mixing holes are arranged in three rows, illustrated in table 401 as a first column, a second column, and a third column. The mixing holes of the arrangement 4001 that are in the first row and second row (represented in the first column and second column respectively of the table 401) of this embodiment 4001 are sized to impede penetration of the fluid flow 240 into the fuel flow 300 and primary mixing zone 200, while only some of the mixing holes in the third row (represented in the third column of the table 401) are necessarily sized to impede penetration of the fluid flow 240 into the fuel flow 300 and primary mixing zone 200. This is the case because in this embodiment, the mixing holes within the third row are themselves of varying sizes, and some may not be of a size that will impede penetration. As to positioning in this embodiment, the first row and the second row are positioned to impede airflow penetration and allow for a less heterogeneous air and fuel mixture 420 (FIG. 12). The mixing holes in the first row are positioned at 24, 48, 84, 132, 156, 204, 228, 276, 300, and 336 degrees around the liner, at a distance of 3.65 inches from the primary nozzle end 150 (as shown in FIG. 6). These mixing holes have a diameter of 0.59 inches. The mixing holes in the second row are positioned at 12, 60, 90, 126, 168, 192, 234, 270, 312, and 348 degrees around the liner, at a distance of 4.9 inches from the primary nozzle end 150. These mixing holes have a diameter 412*b* of 0.71 inches. The mixing holes in the third row are 36 degrees from each other around the liner, at a distance of 3.65 inches from the primary nozzle end 150. These mixing holes alternate between having a diameter of 0.71 inches and a diameter of 1.39 inches in this embodiment.

Three rows, the overall decrease in diameter of the mixing holes of the arrangement 4001, and the positioning of the mixing holes are all elements of the arrangement 4001 that may impede fluid flow 240 penetration, and result in the less heterogeneous mixture 420 shown in FIG. 12. Impeding the fluid flow 240 via this arrangement 4001 causes the fluid flow 240 to penetrate less than or equal to about 165% into the primary mixing zone 200, with an exemplary range of between about 150% and 165% for the first and second rows. Fluid flow 240 from the holes of the third row with a diameter of 0.71 penetrate less than or equal to about 120% into the primary mixing zone 200, with an exemplary range of between about 100% and 120%, while fluid flow 240 from holes of the third row with diameter of 1.39 inches penetrate more than or equal to about 200% into the primary mixing zone 20 with an exemplary range of between about 200% and 220%. It should be appreciated that though the three rows of the arrangement 4001 each include the same number of mixing holes (ten), each individual row may include more or less mixing holes. It should also be appreciated that the arrangement 4001 is intended to increase homogeneity, but may not be intended to maximize homogeneity of a fluid and fuel mixture. A mixture that is too homogeneous will decrease stability along with decreasing NOx emissions. The arrangement 4001 decreases emissions while maintaining a balance between emissions and stability. Striking this balance (i.e. to making a mixture too homogeneous) is one reason why only some of the plurality of mixing holes might be sized and positioned to impede fluid flow 240 penetration into the primary mixing zone 200. In this particular embodiment, the mixing holes in the third row having the diameters of 0.71 and 1.39 are differently sized to specifically cause local heterogeneity to maintain the balance between stability and emissions.

Referring to FIG. 18, an exemplary embodiment of a mixing hole arrangement 5001 that will allow for the improved less heterogeneous air and fuel mixture 420 shown in FIG. 12 is illustrated. FIG. 18 illustrates a table 501 that represents positioning of the mixing hole arrangement 5001 in a liner like liner 104 of FIG. 14. Impeding the fluid flow 240 via this arrangement 5001 causes the fluid flow 240 to penetrate less than or equal to about 165% into the primary mixing zone 200, with an exemplary range of between about 150% and 165%, as was mentioned above and is illustrated in FIG. 13. The arrangement 5001 comprises a plurality of mixing holes represented in the table 501 by a measure of diameter disposed in an appropriate row and column. At least one of the plurality of mixing holes in the arrangement 5001 is at least one of sized (diameter) and positioned to impede airflow penetration into the primary mixing zone 200 shown in FIG. 13.

The combustor 140 in this embodiment is a dry low NOx combustor (like that which is shown in FIG. 6), which may be for an 80 megawatt turbine. The mixing holes of the arrangement 5001 are arranged in three rows, illustrated in table 501 as a first column, a second column, and a third column. The mixing holes in at least one of the three rows are sized (diameter) and positioned to impede penetration of the fluid flow 240 into the fuel flow 300 and primary mixing zone 200. The mixing holes in the first row (represented in the first column of the table 501) are positioned 30 degrees from each other around the liner, at a distance of 5.14 inches from the primary nozzle end 150 (as shown in FIG. 6). These mixing holes have a diameter of 0.784 inches. The mixing holes in the second row (represented in the second column of the table 501) are positioned 30 degrees from each other around the liner, at a distance of 6.39 inches from the primary nozzle end 150. These mixing holes have a diameter of 0.85 inches. The mixing holes in the third row (represented in the third column of the table 501) are positioned 30 degrees from each other around the liner, at a distance of 7.64 inches from the primary nozzle end 15. These mixing holes have a diameter of 0.912 inches.

Three rows, the overall decrease in diameter of the mixing holes of the arrangement 5001, and the positioning of the mixing holes are all elements of the arrangement 5001 that may impede fluid flow 240 penetration, and result in the less heterogeneous mixture 420 shown in FIG. 12. It should be appreciated that though these three rows each include the same number of mixing holes (twelve), each individual row may include more or less mixing holes. It should also be appreciated that the arrangement 5001 is intended to increase homogeneity, but may not be intended to maximize homogeneity of a fluid and fuel mixture. A mixture that is too homogeneous will decrease stability along with decreasing NOx emissions. The arrangement 5001 decreases emissions while maintaining a balance between emissions and stability. Striking this balance (i.e. to making a mixture too homogeneous) is one reason why only some of the plurality of mixing holes might be sized and positioned to impede fluid flow 240 penetration into the primary mixing zone 200.

Referring to FIG. 19, an exemplary embodiment of a mixing hole arrangement 6001 that will allow for the improved less heterogeneous air and fuel mixture 420 shown in FIG. 12 is illustrated. FIG. 19 illustrates a table 601 that represents positioning of the mixing hole arrangement 6001 in a liner like liner 104 of FIG. 14. The arrangement 6001 comprises a plurality of mixing holes represented in the table 601 by a measure of diameter disposed in an appropriate row and column.

At least one of the plurality of mixing holes of the arrangement 6001 is at least one of sized (diameter) and positioned to impede fluid flow 240 penetration into the primary mixing zone 200 shown in FIG. 13.

The combustor 140 in this embodiment is a dry low NOx combustor (like that which is shown in FIG. 6), which may be for an 80 megawatt turbine. The mixing holes are arranged in three rows, illustrated in table 601 as a first column, a second column, and a third column. The mixing holes in at least one of the three rows are sized (diameter) and positioned to impede penetration of the fluid flow 240 into the fuel flow 300 and primary mixing zone 200. In this embodiment mixing hole diameter decreases as the rows move away from the primary nozzle end 150 (FIG. 6), as opposed to increasing as shown in FIG. 18. The mixing holes in the first row (represented in the first column of the table 601) are positioned 30 degrees from each other around the liner, at a distance of 5.14 inches from the primary nozzle end 150. These mixing holes have a diameter of 0.912 inches. The mixing holes in the second row (represented in the second column of the table 601) are positioned 30 degrees from each other around the liner, at a distance of 6.39 inches from the primary nozzle end 150. These mixing holes have a diameter of 0.85 inches. The mixing holes in the third row (represented in the third column of the table 601) are positioned 30 degrees from each other around the liner, at a distance of 7.64 inches from the primary nozzle end 150. These mixing holes have a diameter of 0.784 inches.

Three rows, the overall decrease in diameter of the mixing holes in the arrangement 6001, and the positioning of the mixing holes are all elements of the arrangement 6001 that may impede fluid flow 240 penetration, and result in the less heterogeneous mixture 420 shown in FIG. 12. Impeding the fluid flow 240 via this arrangement 6001 causes the fluid flow 240 to penetrate variously depending on whether the flow is from the holes in the first row second row or third row. Fluid flow 240 from the first row has maximum penetration and penetrates more than or equal to about 250% into the primary mixing zone 200 with and exemplary range between about 250% and 280%. Fluid flow from the second row penetrates less than or equal to about 175% into the primary mixing zone 200, with an exemplary range of between about 130% and 175%, whereas the third row penetrates less than or equal to about 100% into the primary mixing zone 200, with an exemplary range of between about 80% and 100%. It should be appreciated that though these three rows each include the same number of mixing holes (twelve), each individual row may include more or less mixing holes. It should also be appreciated that the arrangement 6001 is intended to increase homogeneity, but may not be intended to maximize homogeneity of a fluid and fuel mixture. A mixture that is too homogeneous will decrease stability along with decreasing NOx emissions. The arrangement 6001 decreases emissions while maintaining a balance between emissions and stability. Striking this balance (i.e. to making a mixture too homogeneous) is one reason why only some of the plurality of mixing holes might be sized and positioned to impede fluid flow 240 penetration into the primary mixing zone 200.

Referring to FIG. 20, an exemplary embodiment of a mixing hole arrangement 7001 that will allow for the improved less heterogeneous air and fuel mixture 420 shown in FIG. 12 is illustrated. FIG. 20 illustrates a table 701 that represents positioning of the mixing hole arrangement 7001 in a liner like liner 104 of FIG. 14. Impeding the fluid flow 240 via this arrangement 7001 causes the fluid flow 240 to penetrate less than or equal to about 138% into the primary mixing zone 200, with an exemplary range of between about 110% and 138%, as was mentioned above and is illustrated in FIG. 13. The arrangement 7001 comprises a plurality of mixing holes represented in the table 701 by a measure of diameter disposed in an appropriate row and column. At least one of this plurality of mixing holes in the arrangement 7001 is at least one of sized (diameter) and positioned to impede fluid flow 240 penetration into the primary mixing zone 200 shown in FIG. 13.

The combustor 140 in this embodiment is a dry low NOx combustor (like that which is shown in FIG. 6), which may be for an 80 megawatt turbine. The mixing holes are arranged in three rows, illustrated in table 701 as a first column, a second column, and a third column. The mixing holes in at least one of the three rows are sized (diameter) and positioned to impede penetration of the fluid flow 240 into the fuel flow 300 and primary mixing zone 200. In this arrangement 7001, size of the mixing holes remains constant throughout all three rows (respectfully represented in the first column, second column, and third column of the table 701), with each mixing hole having a diameter of 0.85 inches. The mixing holes in the first row (represented in the first column of the table 701) are positioned 30 degrees from each other around the liner, at a distance of 5.14 inches from the primary nozzle end 150 (as shown in FIG. 6). The mixing holes in the second row (represented in the second column of the table 701) are positioned 30 degrees from each other around the liner, at a distance of 6.39 inches from the primary nozzle end 150. The mixing holes in the third row (represented in the third column of the table 701) are positioned 30 degrees from each other around the liner, at a distance of 7.64 inches from the primary nozzle end 150.

Three rows, the overall decrease in diameter of the mixing holes in the arrangement, and the positioning of the mixing holes are all elements of the arrangement 7001 that may impede fluid flow 240 penetration, and result in the less heterogeneous mixture 420 shown in FIG. 12. It should be appreciated that though these three rows each include the same number of mixing holes (twelve), each individual row may include more or less mixing holes. It should also be appreciated that the arrangement 7001 is intended to increase homogeneity, but may not be intended to maximize homogeneity of a fluid and fuel mixture. A mixture that is too homogeneous will decrease stability along with decreasing NOx emissions. The arrangement 7001 decreases emissions while maintaining a balance between emissions and stability. Striking this balance (i.e. to making a mixture too homogeneous) is one reason why only some of the plurality of mixing holes might be sized and positioned to impede fluid flow 240 penetration into the primary mixing zone 200.

Figure 21:
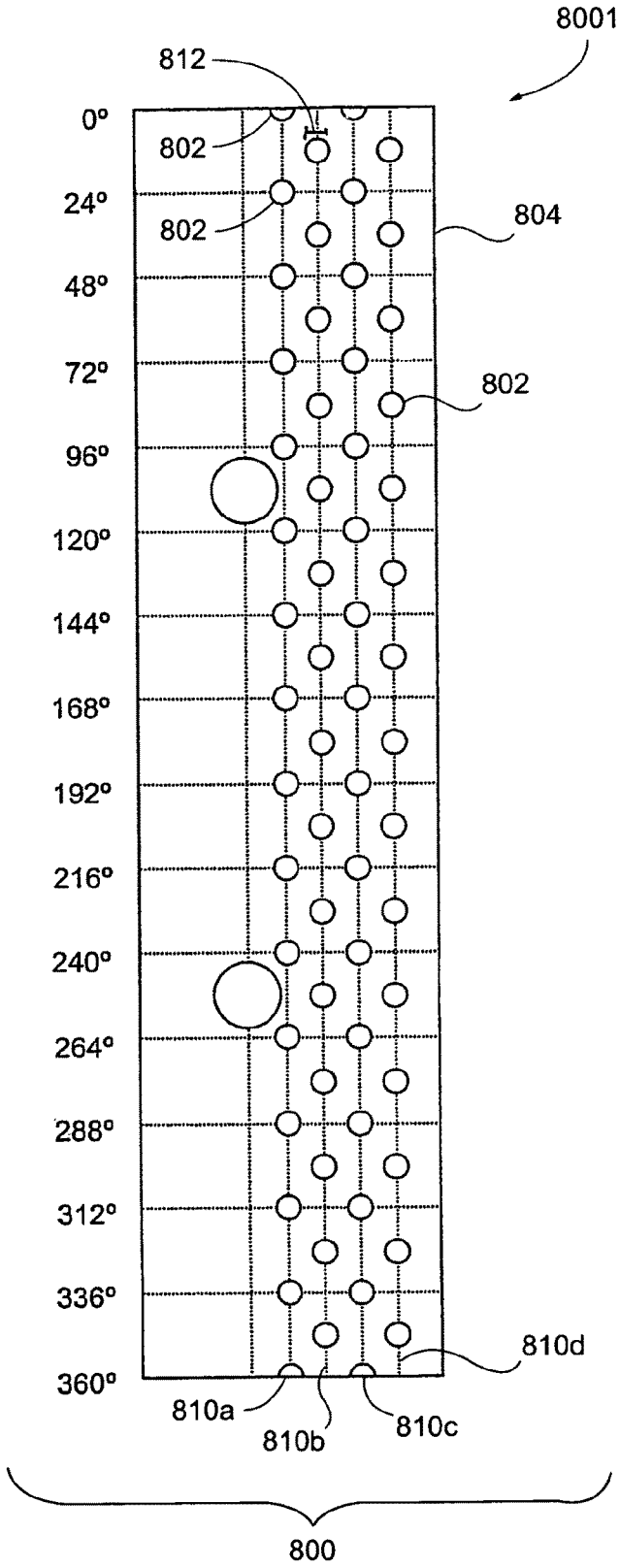
FIG. 21 shows a schematic view of a head end portion of a liner of a combustor that is illustrated substantially flatly and in accordance with an exemplary embodiment of a mixing hole arrangement 8001.

Referring to FIG. 21, an exemplary embodiment of a mixing hole arrangement 8001 that will allow for the improved less heterogeneous air and fuel mixture 420 shown in FIG. 12 is illustrated. This arrangement 8001 impedes penetration of the fluid flow 240 into the fuel flow 300 and primary mixing zone 200, allowing for the homogeneous mixture 420. Impeding the fluid flow 240 via this arrangement 8001 causes the fluid flow 240 to penetrate less than or equal to about 110% into the primary mixing zone 200, with an exemplary range of between about 90% and 110%, as was mentioned above and is illustrated in FIG. 13. The arrangement 8001 comprises a plurality of mixing holes 802 defined by a liner 804 (the illustration is flat, though in application the mixing holes 802 are disposed circumferentially about the liner 804, which is cylindrical in construction) of the head end 806. At least one of this plurality of mixing holes 802 is at least one of sized (diameter) and positioned to impede fluid flow penetration into the primary mixing zone 200 shown in FIG. 13.

The combustor 140 in this embodiment is a dry low NOx combustor (like that which is shown in FIG. 6), which may be for an 80 megawatt turbine. The mixing holes 802 are arranged in four rows, illustrated as a first row 810*a*, a second row 810*b*, a third row 810*c*, and a fourth row 810*d*. The mixing holes 802 in at least one of the four rows 810*a-d* are sized (diameter) and positioned to impede penetration of the fluid flow 240 into the fuel flow 300 and primary mixing zone 200. In this embodiment, mixing hole 802 size remains constant throughout all four rows 810*a-d*, with each mixing hole 802 having a diameter 812 of 0.655 inches. The mixing holes 802 in the first row 810*a* are positioned 24 degrees from each other around the liner 804, at a distance of 5.14 inches from the primary nozzle end 150 (as shown in FIG. 6). The mixing holes 802 in the second row 810*b* are positioned 24 degrees from each other around the liner 804, at a distance of 6.39 inches from the primary nozzle end 150. The mixing holes 802 in the third row 810*c* are positioned 24 degrees from each other around the liner 804, at a distance of 7.64 inches from the primary nozzle end 150. The mixing holes 802 in the fourth row 810*d* are positioned 24 degrees from each other around the liner 804, at a distance of 8.89 inches from the primary nozzle end 150.

Four rows, the overall decrease in diameter 812 of the mixing holes 802, the positioning of the mixing holes 802, and the number (fifteen) of mixing holes in each row 810*a-d* are all elements of the arrangement 8001 that may impede fluid flow 240 penetration, and result in the less heterogeneous mixture 420 shown in FIG. 12. It should be appreciated that though these four rows 810*a-d* each include the same number of mixing holes 802 (fifteen), each individual row may include more or less mixing holes 802. It should also be appreciated that the arrangement 8001 is intended to increase homogeneity, but may not be intended to maximize homogeneity of a fluid and fuel mixture. A mixture that is too homogeneous will decrease stability along with decreasing NOx emissions. The arrangement 8001 decreases emissions while maintaining a balance between emissions and stability. Striking this balance (i.e. to making a mixture too homogeneous) is one reason why only some of the plurality of mixing holes 802 might be sized and positioned to impede fluid flow 240 penetration into the primary mixing zone 200.

Referring to FIGS. 22 and 23, two embodiments of a mixing hole arrangement 8001 and 9001 that will each allow for the improved less heterogeneous air and fuel mixture 420 shown in FIG. 12 is illustrated. FIGS. 22 and 23 illustrate tables 801 and 901 that represent positioning of the two embodiments of the mixing hole arrangement 8001 and 9001, respectively, each in a liner like liner 104 of FIG. 14. The arrangement 8001 and 9001 comprise a plurality of mixing holes represented in the tables 801 and 901 by a measure of diameter disposed in an appropriate row and column. At least one of this plurality of mixing holes of the arrangement 8001 and 9001 is at least one of sized (diameter) and positioned to impede fluid flow 240 penetration into the primary mixing zone 200 shown in FIG. 13.

The combustor 140 in this embodiment is a dry low NOx combustor (like that which is shown in FIG. 6), which may be for an 80 megawatt turbine. The mixing holes of the arrangement 9001 in at least one of the three rows are sized (diameter) and positioned to impede airflow penetration of the fluid flow 240 into the fuel flow 300 and primary mixing zone 200. In this arrangement 9001, mixing hole diameter varies in the first row and third row (represented in the first column and third column respectively of the tables 801 and 901). The mixing holes in the first row of both embodiments are positioned 20 degrees from each other around the liner, at a distance of between about 4.75 and 5.14 inches from the primary nozzle end 150 (as shown in FIG. 6). These mixing holes alternate between having a diameter of 0.784 inches and a diameter of 0.912 inches. The mixing holes in the second row (represented in the second column of the tables 801 and 901) of both embodiments are positioned 20 degrees from each other around the liner, at a distance of 6.39 inches from the primary nozzle end 15. These mixing holes have a diameter of 0.85 inches. The mixing holes in the third row of both embodiments are positioned 20 degrees from each other around the liner, at a distance of from 7.64 to 8.15 inches from the primary nozzle end 150. These mixing holes alternate between having a diameter of 0.784 inches and a diameter of 0.912 inches.

Three rows, the overall decrease in diameter of the mixing holes in the arrangement 9001, and the positioning of the mixing holes are all elements of the arrangement 9001 that may impede fluid flow 240 penetration, and result in the less heterogeneous mixture 420 shown in FIG. 12. Impeding the fluid flow 240 via this arrangement 9001 causes the fluid flow 240 in the second row to penetrate less than or equal to about 165% into the primary mixing zone 200, with an exemplary range of between about 150% and 165%, fluid flow 240 from holes in the first and third rows of the diameter of 0.74 inches to penetrate less than or equal to about 155% into the primary mixing zone 200, with an exemplary range of between about 140% and 155%, fluid flow 240 from holes in the first and third rows of the diameter of 0.912 inches to penetrate more than or equal to about 175% with an exemplary range of between about 175% and 185%. It should be appreciated that though these three rows each include the same number of mixing holes (twelve), each individual row may include more or less mixing holes. It should also be appreciated that the arrangement 9001 is intended to increase homogeneity, but may not be intended to maximize homogeneity of a fluid and fuel mixture. A mixture that is too homogeneous will decrease stability along with decreasing NOx emissions. The arrangement 9001 decreases emissions while maintaining a balance between emissions and stability. Striking this balance (i.e. to making a mixture too homogeneous) is one reason why only some of the plurality of mixing holes might be sized and positioned to impede fluid flow 240 penetration into the primary mixing zone 200.

The mixing hole arrangement described above is also applicable to the embodiment incorporating expansion of fluid flow within the combustor described below. In this case, the mixing hole arrangement refers to the upstream portion of the liner shown in FIG. 25.

The combustor of a gas turbine according to an exemplary embodiment presented herein is designed in such a way so that the fluid flow within the combustor chamber is expanded before it passes the downstream end of the centerbody of the upstream portion of the combustor. This helps improve the emissions performance and stability of the combustor flames.

Figure 24:
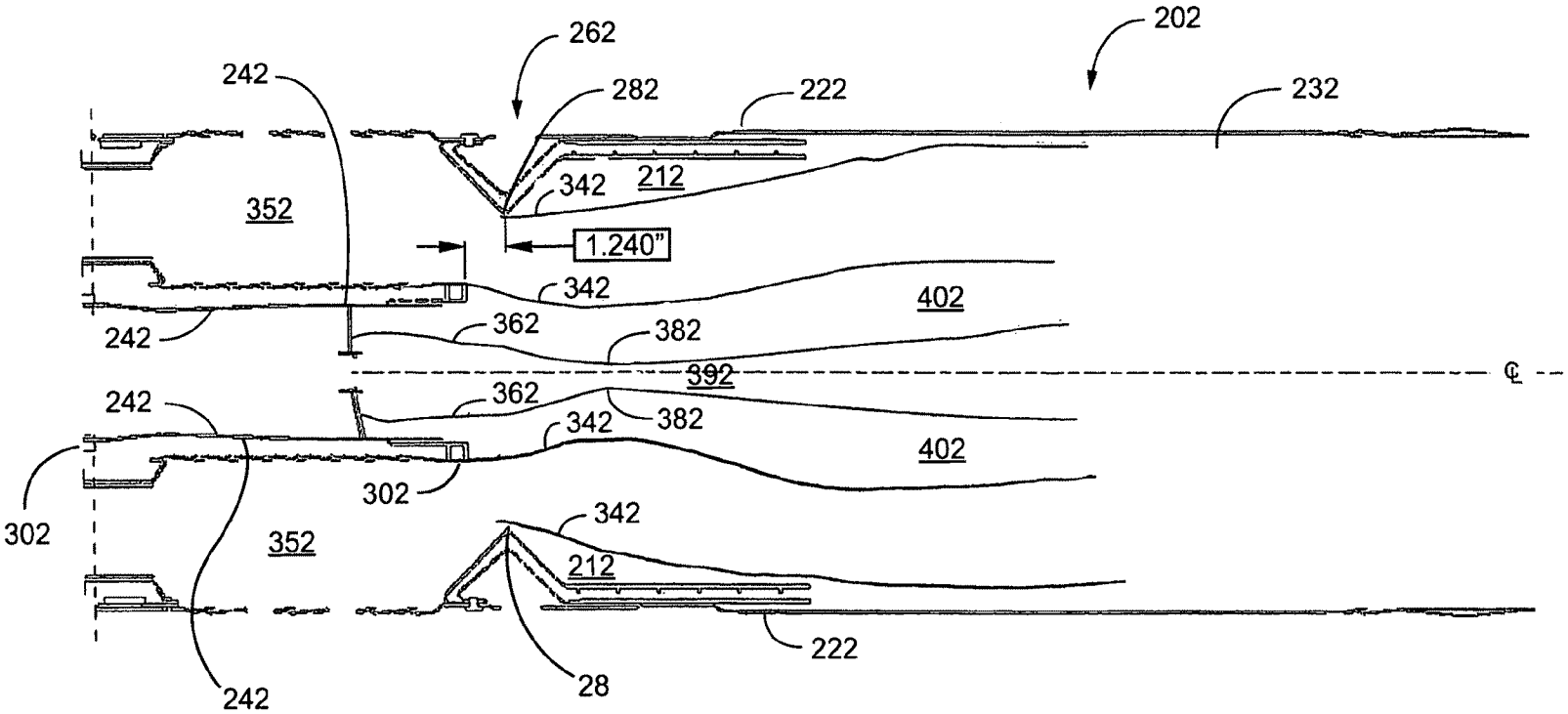
Fig. 24 (Prior Art)
FIG. 24 shows a schematic cross section view of a prior art venturi arrangement in a combustor liner.

In a prior art combustor shown in FIG. 24, a combustor 202 defining a liner cavity 232 and including a venturi 222 and a centerbody 242 is illustrated. The centerbody 242 includes an upstream end 302 and a downstream end 322. The venturi 222 defines a venturi throat 282 that is disposed radially outwardly of the centerbody 242. The venturi throat 282 (as shown in FIG. 24) is disposed downstream of the downstream end 322 of the centerbody 242, and an annular cavity 352 is disposed annularly outwardly about the centerbody 242. From this annularly cavity 352, an annular fluid flow 342 flows into and past a recirculation region 212 of the liner cavity 232. Also flowing into the liner cavity 232 is a center fluid flow 362, which flows from the centerbody 242.

Because the venturi throat 282 is disposed downstream of the downstream end 322, the annular fluid flow 342 is directed by the venturi throat 282 toward the center fluid flow 362, after the annular fluid flow 362 has exited the annular cavity 352. In this type of arrangement 262, the annular fluid flow 342 impinges upon the center fluid flow 362 downstream of the downstream end 322, creating a pinching 382 of the center flow 362 in a centerline recirculation region 392 of the liner cavity 232. The pinching effect tends to destabilize combustor flames thereby making combustion dynamics or blow-out a greater probability. In addition (when the venturi throat 282 and the downstream end 322 are arranged in this manner), it is not until after the annular fluid flow 362 has passed both the downstream end 322 of the centerbody 242 and the venturi throat 282 that it may expand and create a lower pressure region 402 that will facilitate expansion of the center fluid flow 362. This delays interaction of a flame (not illustrated) associated with the center fluid flow 362 and a flame (not illustrated) associated with the annular fluid flow 342.

Figure 25:
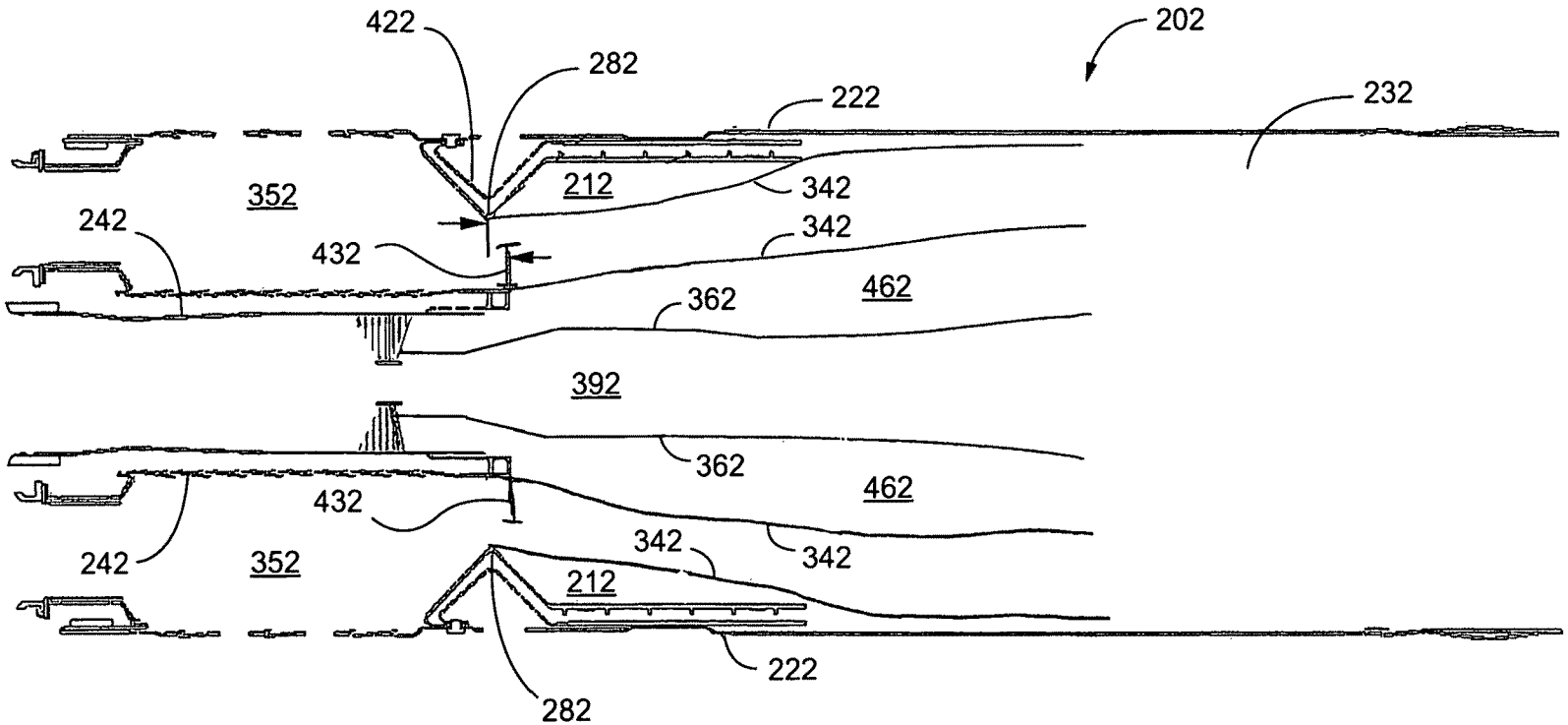
FIG. 25 shows a schematic cross section view of a combustor liner according to an exemplary embodiment for producing expanded annular fluid flow and center fluid flow.

Referring now to FIG. 25, the venturi throat 282 and downstream end 322 of the centerbody 242 are illustrated in an exemplary embodiment of an arrangement 422 that improves expansion of the annular fluid flow 342 and center fluid flow 362 in the recirculation region 212, thereby simultaneously improving both NOx reduction and flame stability. In this arrangement 422, the venturi throat 282 is disposed less than 0.19 inches downstream of the downstream end 322 of the centerbody 242. The venturi throat 282 may be disposed less than 0.19 inches downstream of the downstream end 322 of the centerbody 242 by moving or extending the centerbody 242 downstream, or moving the venturi throat 282 upstream within the venturi 222. In an exemplary embodiment, such as that which is shown in FIG. 25, the venturi throat 282 is disposed 0.5 inches upstream of the downstream end 322 of the centerbody 242. In another exemplary embodiment, the venturi throat 282 is disposed 0.31 inches upstream of the downstream end 322 of the centerbody 242. The venturi throat 282 may also be disposed coplanar to (or in a same plane 432 with) the downstream end 322 of said centerbody 242.

By disposing the venturi throat 282 upstream of the downstream end 322 of the centerbody 242 in these exemplary embodiments, the annular fluid flow 342 is directed by the venturi throat 282 toward the centerbody 242, with the directing occurring upstream of the downstream end 322 of the centerbody 242. By positioning the venturi throat 282 in this manner, the annular fluid flow 342 will begin to expand before moving downstream of the downstream end 322 of the centerbody 242. Since the annular fluid flow 342 is already expanding as it passes the downstream end 322 of the centerbody 242, it does not restrict the expansion of the center fluid flow 362 but creates a lower pressure region 462 to which the center fluid flow 362 will be exposed upon entry to the liner cavity 232. This lower pressure region 462 facilitates expansion of the center fluid flow 362 with the annular fluid flow 342.

Earlier expansion of the center fluid flow 362 (in terms of fluid flow direction, and as compared with a component arrangement of FIG. 24) enhances center fluid flow 362 recirculation in the recirculation region 212, which allows a faster interaction between the flame (not illustrated) associated with the center fluid flow 362 and the flame (not illustrated) associated with the annular fluid flow 342. This faster interaction reduces cold streaks in the combustor 202, and improves NOx emissions performance by decreasing CO emissions at a given NOx level, thereby facilitating the combustor 202 to run at a leaner fuel-air mixture and thus produce less NOx emissions. Earlier expansion also eliminates pinching 382 (see FIG. 24), which increases the centerline circulation region 392 size, and improves the stability of combustor 202. It should be appreciated that in an exemplary embodiment, the combustor 202 is a dry low NOx combustor, which utilizes fuel-lean mixtures and does not use diluents (e.g., water injection) to reduce flame temperature.

In the combustor of the exemplary embodiment presented herein, the amount of undesirable NOx pollutants can be decreased by supplying dilution air in the transition piece of the combustor. This helps reduce the temperature of the reactants in the combustor.

In one prior transition piece, two dilution holes are located adjacent the outlet of the transition piece, close to the first stage nozzle. In commonly owned Publication No. US 2005/0204741 A1, there is provided a transition piece dilution air management system which promotes dilution mixing and emissions reduction. Particularly, the dilution air management system provides dilution air jets in the transition piece at predetermined axial and circumferential locations to optimize reductions in emissions consistent with efficient use of compressor discharge air. However, undesirable emissions remain a problem notwithstanding the various prior proposals.

Figure 27:
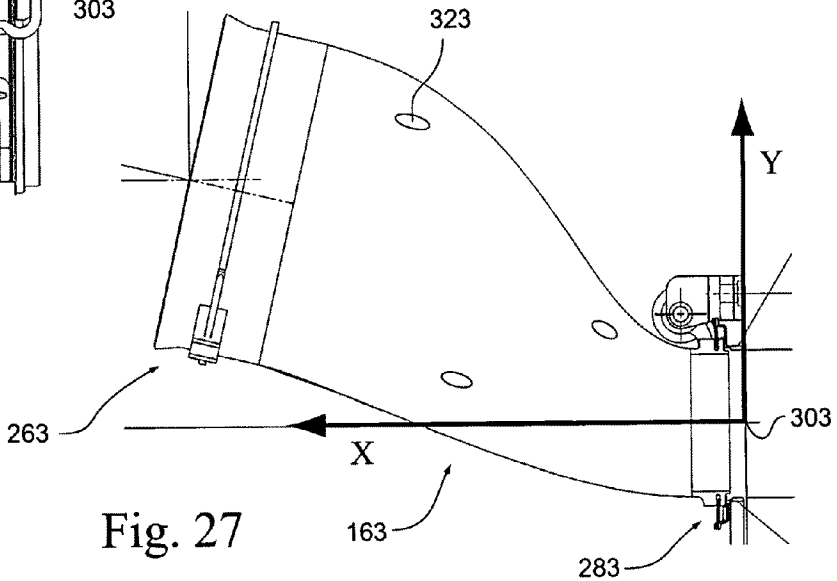
FIG. 27 shows a side elevation view of the transition piece shown in FIG. 26.
Figure 26:
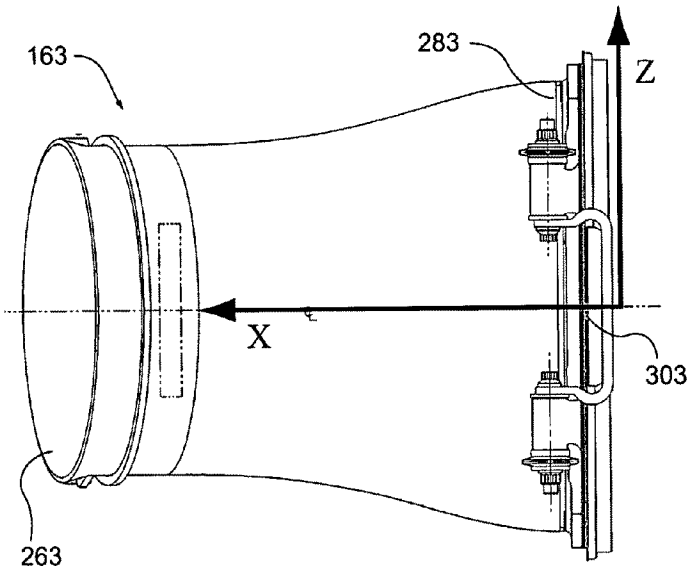
FIG. 26 shows a plan view of a transition piece incorporating dilution holes according to an exemplary embodiment.
Figure 28:
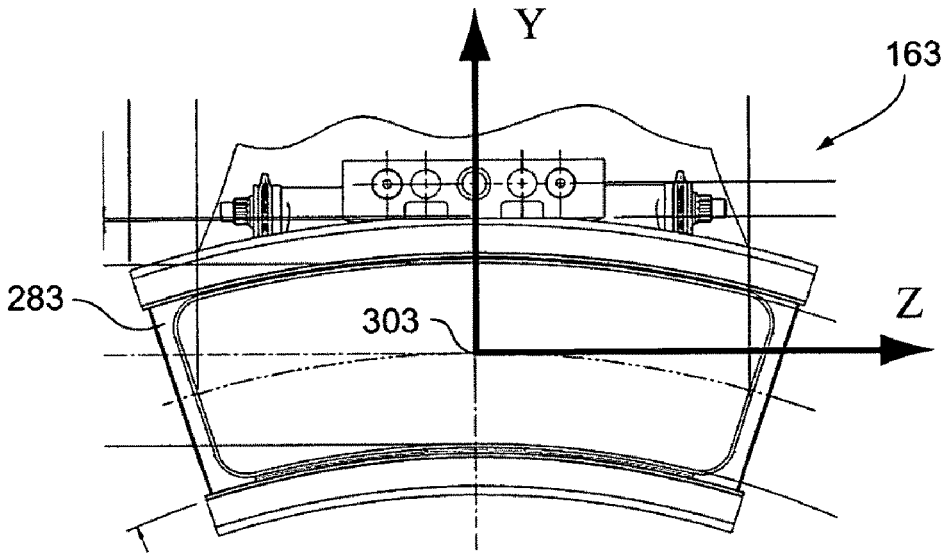
FIG. 28 shows an aft end view of the transition piece shown in FIG. 26 and FIG. 27.

With further reference to FIGS. 26-28, the exemplary embodiment presented herein relates to a unique arrangement of dilution holes in the transition piece 163, the number, size and location of which promote dilution air mixing, allow for longer combustion residence time, (thus also enabling a more stable formation of combustion flame zones), improve flame stability and facilitate complete burning of hydrocarbons. The transition piece 163 is essentially a duct body or enclosure having a forward end 263 (towards the outlet end of the combustor chamber) and an aft end 283 (towards the first stage turbine nozzle), with the cross-sectional shape of the duct body varying from a substantially cylindrical shape at the forward end to a curved rectangular shape at the aft end.

In an exemplary embodiment, plural dilution holes 323 (three are shown in FIG. 27 by way of example only) are formed in the transition piece 163, located precisely along and about the duct body, as measured in inches along X, Y and Z coordinates, from an origin or zero reference point, at the center 303 of the transition piece (or duct body) exit plane. The X coordinate extends from the origin 303 in an upstream direction, i.e., in a direction opposite the flow through the transition piece. In this exemplary embodiment, the transition piece is about twenty inches in length. Twenty eight (28) dilution hole locations have been identified as viable locations for realizing emissions reductions. The X, Y, Z coordinates of the twenty eight dilution hole locations are set out in Table I below.

TABLE I

| HOLE # | X | Y | Z |
|---|---|---|---|
| 1 | 14.59 | 10.26 | 4.78 |
| 2 | 16.45 | 2.21 | 0 |
| 3 | 14.59 | 10.26 | −4.78 |
| 4 | 13.97 | 12.96 | 0 |
| 5 | 15.82 | 4.91 | 4.78 |
| 6 | 15.82 | 4.91 | −4.78 |
| 7 | 10.63 | 1.25 | −5.6 |
| 8 | 10.91 | 1 | 5.05 |
| 9 | 8.84 | −0.97 | 2.9 |
| 10 | 8.84 | −0.9 | −2.27 |
| 11 | 6.9 | 7.44 | 2 |
| 12 | 4.59 | 4.485 | −5.23 |
| 13 | 4.59 | 3.56 | 0 |
| 14 | 4.59 | −2.11 | 0 |
| 15 | 2.59 | 0.06 | 7.647 |
| 16 | 2.59 | −2.21 | 6.92 |
| 17 | 2.59 | −2.98 | 4.33 |
| 18 | 2.59 | −2.56 | 0 |
| 19 | 2.59 | −2.98 | 4.33 |
| 20 | 2.59 | −1.07 | −7.29 |
| 21 | 4.09 | 3.7 | 1.82 |
| 22 | 4.09 | 3.12 | 5.42 |
| 23 | 4.09 | −2.9 | 4.76 |
| 24 | 4.09 | −2.9 | −4.76 |
| 25 | 4.09 | −2.21 | −6.92 |
| 26 | 4.09 | 3.197 | 5 |
| 27 | 4.09 | −3.7 | 1.82 |
| 28 | 4.09 | −3.7 | −1.82 |

The number of dilution holes provided in the transition piece or duct body 163 may vary between five (5) and seventeen (17), with eleven (11) being the optimum number in the exemplary embodiment. The holes 323 lie along the transition piece or duct body in an envelope within one inch in any direction along the surface of the transition piece from the locations of the holes determined by the X, Y and Z coordinates. In this regard, any combination of the twenty eight hole location sites listed in Table I may be selected for the 5-17 dilution holes. The dilution hole diameter may be in the range of from 0.3 to 1.75 in. and the combined open surface area of the dilution holes should be in the range of from 2 to 7.5 sq. inches. The dilution holes 323 may have uniform or different diameters within the specified range.

The dilution hole arrangement as described allows for longer combustion residence time (due to lower temperatures) and hence additional CO burnout. This also enables more stable formation of the combustion flame zone, and improves flame stability instead of quenching the combustion process prior to complete burning of hydrocarbons. The end result is a reduction in harmful emissions and improved liner durability.

According to an exemplary embodiment, combustor emissions are reduced and flame stability is increased by providing improved air/fuel mixing and additional airflow to other components/systems of the turbomachine.

Figure 29:
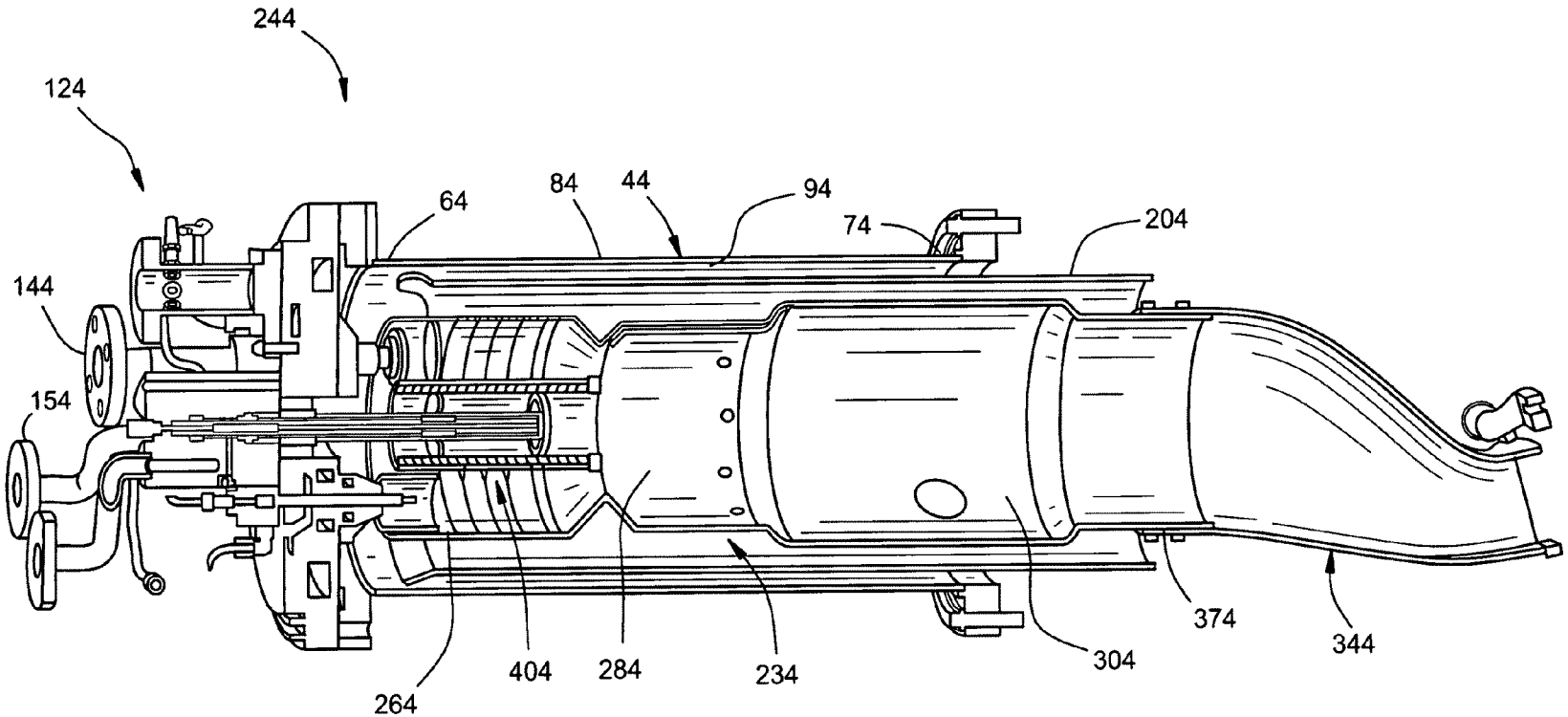
FIG. 29 shows a cross-sectional side view of a combustor assembly including a centerbody cap according to an exemplary embodiment.

Referring to FIG. 29, a turbomachine combustor assembly constructed in accordance with exemplary embodiments of the invention is indicated generally at 244. The combustor assembly 244 includes an outer casing 44 having a first end portion 64 that extends to a second end portion 74 through an intermediate portion 84 that collectively define an interior portion 94. Combustor assembly 44 is also shown to include an end cover assembly 124 arranged at first end portion 64 of outer casing 44. End cover assembly 124 is shown to include a primary nozzle 144 and a secondary nozzle 154. Fuel is introduced through the end cover assembly 124, mixed with air and ignited to form high temperature/high pressure gases that are utilized to drive a turbine (not shown). Towards that end, combustor assembly 244 includes a flow sleeve 204 that extends within interior portion 94 and houses a liner assembly 234.

As shown, liner assembly 234 includes a head end section 264 that extends to a venturi section 284 to an end liner portion 304. The end liner portion 304 is coupled to a transition piece 344 via a hula seal assembly 374. A cap assembly 404 extends from end cover assembly 124, through head end section 264 toward venturi section 284. Fuel and air are introduced into cap assembly 404 and head end section 264, mixed and delivered into venturi section 284 where the fuel/air mixture is ignited to form high temperature/high pressure gases that pass to end liner portion 304, through transition piece 344 and toward a first stage of a turbine (not shown).

Figure 30:
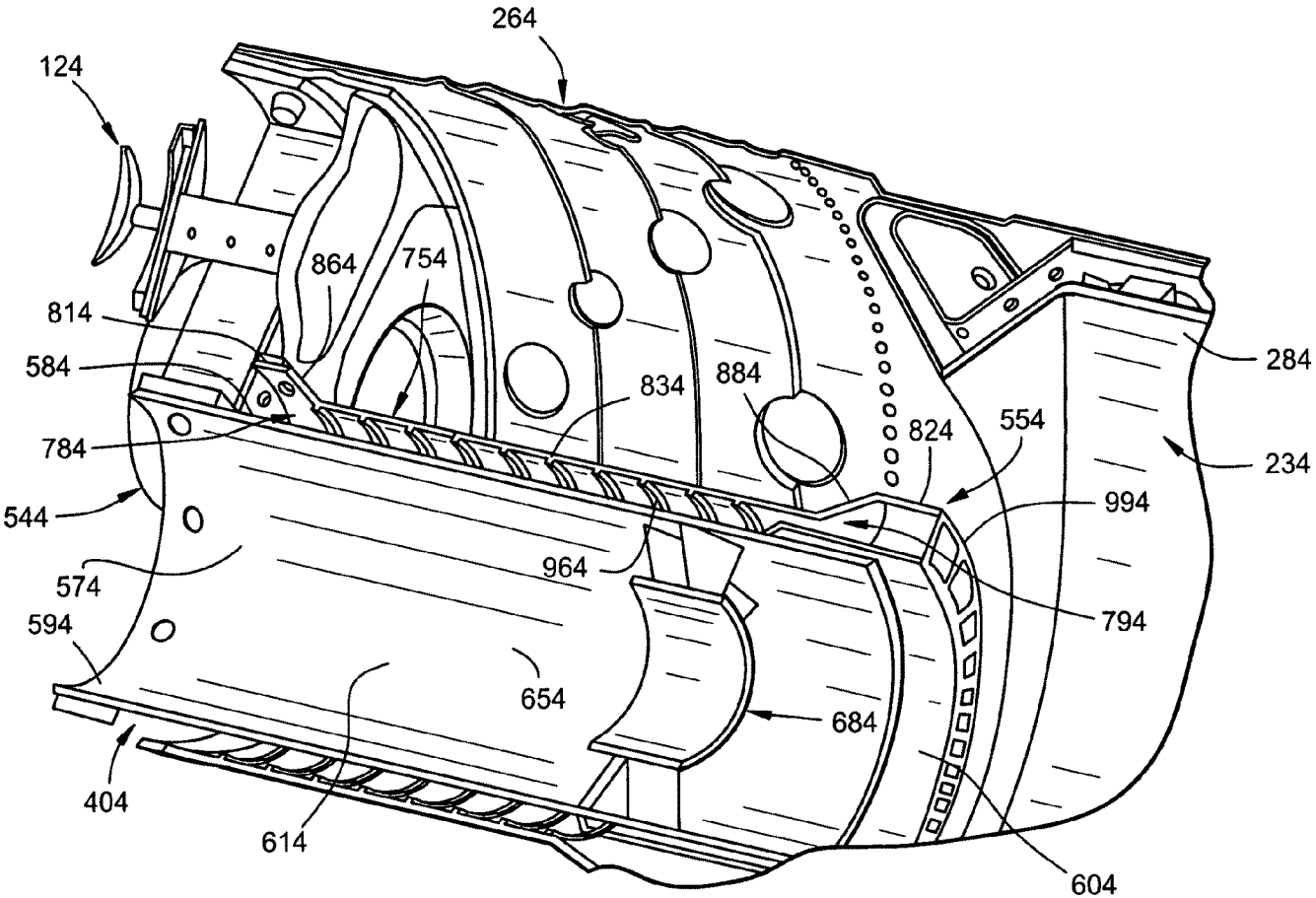
FIG. 30 shows a cross-sectional side view of the centerbody cap assembly of FIG. 29.
Figure 31:
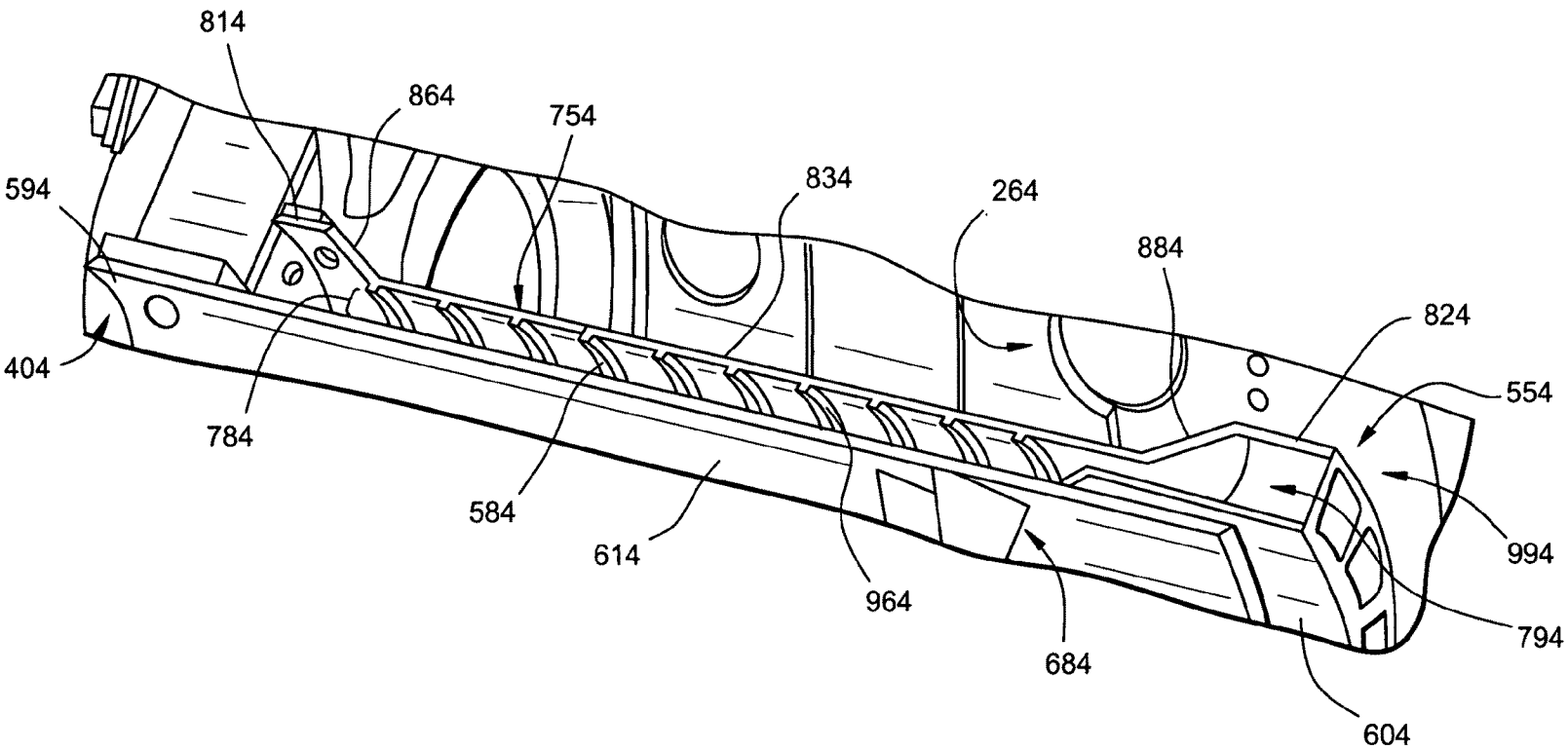
FIG. 31 shows a detail view of an external turbulator portion of the centerbody cap assembly of FIG. 30.

As best shown in FIGS. 30, 31, cap assembly 404 includes a centerbody 544 and a cap 554. Cap assembly 404 is mounted to head end section 264 and protects secondary nozzle assembly 154. As will be discussed more fully below, cap assembly 404 also shrouds cooling air necessary for cooling centerbody 544. As shown, centerbody 544 includes a wall 574 having an outer surface 584 that extends from a first end 594 to a second end 604 through an intermediate portion 614 defining an internal passage 654. In the exemplary embodiment shown, internal passage 654 has a diameter of about 3 inches (7.62 cm). However, it should be understood that the diameter of internal passage 654 can vary in accordance with exemplary embodiments of the invention. An inner swirler or turbulator 684 is arranged within internal passage 654 near second end 604. Inner turbulator 684 imparts a swirling effect to the fuel/air mixture to enhance mixing.

In further accordance with the exemplary embodiment shown, cap assembly 404 includes an external turbulator member 754 that encapsulates centerbody 544 extending along wall 574 from first end 594 towards second end 604. More specifically, external turbulator member 754 is mounted to, yet spaced from, cap assembly 404 so as to define a gap or passage 784 having a width "w". Cooling air-passes along passage 784 before exiting cap 554. External turbulator member 754 includes a first end section 814 extending to a second end section 824 through an intermediate section 834. A step 884 having a height "s" is arranged at second end section 824. That is, step 884 defines a radial distance "s" between second end section 824 and intermediate section 834. In any event, in accordance with one exemplary aspect of the invention, width "w" and radial distance "s" are sized so that external turbulator 754 includes a step-to-gap ratio ("s"/"w") in a range of about 0.8 to about 1.2. Of course, it should be understood that the particular step-gap-ratio range can vary depending on turbomachine size and/or rating. In accordance with another exemplary aspect of the invention, width "w" and radial distance "s" are sized so that external turbulator 754 includes a step-to-gap ratio in a range of about 0.9 to about 1.1. In accordance with yet another exemplary aspect of the invention, width "w" and radial distance "s" are sized so that external turbulator 754 includes a has a step-to-gap ratio of about 1.0.

In addition, external turbulator member 754 includes a plurality of cooling ribs 964 that extend circumferentially about centerbody 544, and a turbulator portion 994 arranged at second end section 834. Cooling ribs 964 enhance heat transfer from external turbulator member 754. Moreover, the step-to-gap ratio, in accordance with the exemplary embodiments of the invention, reduces an amount of cooling airflow required. More specifically, the step enhances external mixing of a fuel air mixture passing over an external surface of the external turbulator while the gap reduces cooling air flow passing over the centerbody. That is by sizing the step-to-gap ratio for a particular desired flow rate, turbomachine emissions are reduced and flame stability is increased. The combined reduction in emissions and increased flame stability enhances combustion efficiency, which results in overall efficiency improvements of the turbomachine. By reducing the amount of cooling air/fuel passing over centerbody 544 by decreasing gap 784 and providing improved air/fuel mixing by increasing step 864 and/or 884, additional airflow is available for other components/systems in the turbomachine. This additional airflow enhances operational efficiencies for the turbomachine.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A gas turbine combustor comprising:

a primary combustion chamber;

a secondary combustion chamber downstream of the primary combustion chamber;

a venturi connecting said primary and secondary combustion chambers, said venturi having a venturi throat;

a transition piece connected to a downstream end of the secondary combustion chamber for confining a flow of combustion products from the combustor to a turbine first stage nozzle;

a cap assembly attached to the primary combustion chamber, said cap assembly comprising a centerbody having a first end and a second end, and an external turbulator member in operable communication with the cap assembly and being spaced from a wall of the centerbody to form a gap that defines a passage, wherein the primary combustion chamber includes a mixing hole arrangement for improving homogeneity of an air and fuel mixture in the combustor, the mixing hole arrangement including a plurality of mixing holes in a liner of the primary combustion chamber at least one of which is a mixing hole that is sized and positioned so that to impede a fluid flow penetration into a primary mixing zone located at the upstream end of the combustor;

the venturi throat is disposed within a predetermined distance upstream from the downstream end of the primary combustion chamber;

the transition piece is composed of a duct body, with a plurality of dilution holes formed in said duct body, said dilution holes located at selected X, Y and Z coordinates measured from a zero reference point at a center of an exit plane of the transition piece, and the external turbulator member including a step positioned at the second end of the centerbody, the step defining a radial distance about the second end of the centerbody, wherein the external turbulator is formed having a step-to-gap ratio relative to the centerbody in a range of about 0.8 to about 1.2.

2. The gas turbine combustor according to claim 1, wherein said impeding mixing hole allows said fluid flow to penetrate between about 100% and 165% into said primary mixing zone.

3. The gas turbine combustor according to claim 2, wherein said plurality of mixing holes are disposed around circumferentially around said liner in at least three rows.

4. The gas turbine combustor according to claim 3, wherein at least one of said at least three rows is positioned less than about 4.9 inches from a primary nozzle end of the combustor.

5. The gas turbine combustor according to claim 3, wherein said impeding mixing hole has a diameter that is less than about 1.04 inches.

6. The gas turbine combustor according to claim 3, wherein at least two rows each include a plurality of mixing holes numbering more than 6.

7. The gas turbine combustor according to claim 3, wherein said plurality of mixing holes are disposed in a first row, a second row, and a third row, and each of said plurality of mixing holes disposed in each row are positioned about 30 degrees from each other, relative to longitudinal central axis of the combustor.

8. The gas turbine combustor according to claim 1, wherein the venturi throat is disposed less than 0.19 inches downstream of the downstream end of the primary combustion chamber.

9. The gas turbine combustor according to claim 8, wherein said venturi throat is disposed from less than 0.19 inches downstream of said downstream end of the primary combustion chamber to about 0.5 inches upstream of said downstream end of the primary combustion chamber.

10. The gas turbine combustor according to claim 9, wherein said venturi throat is disposed from about 0.31 inches to about 0.5 inches upstream of said downstream end of the primary combustion chamber.

11. The gas turbine combustor according to claim 1, wherein said selected X, Y and Z coordinates are listed in Table I.

12. The gas turbine combustor according to claim 11, wherein said plurality of dilution holes have uniform diameters in a range of from 0.3 to 1.75 inches.

13. The gas turbine combustor according to claim 12, wherein said plurality of dilution holes have a combined cross-sectional open area of between 2.0 and 7.5 square inches.

14. The gas turbine combustor according to claim 11, wherein said plurality of dilution holes comprises between 5 and 17 holes having locations selected from any combination of X, Y and Z coordinate sets listed in Table I.

15. The gas turbine combustor according to claim 11, wherein some or all of said plurality of dilution holes have different diameters within a range of from 0.3 to 1.75 inches.

16. The gas turbine combustor according to claim 1, wherein said step-to-gap ratio is about 1.0.

17. The gas turbine combustor according to claim 1, wherein the at least one step of the external turbulator member includes a first step positioned at the first end and a second step positioned at the second end.

18. A method for achieving $NO_x$ emissions of less than 5 ppm in a gas turbine combustor, said combustor including a primary combustion chamber, a secondary combustion chamber downstream of the primary combustion chamber, a venturi connecting said primary and secondary combustion, chambers, said venturi having a venturi throat, a transition piece connected to a downstream end of the secondary combustion chamber for confining a flow of combustion products from the combustor to a turbine first stage nozzle, and a cap assembly attached to the primary combustion chamber and having a centerbody, said method comprising:

impeding a fluid flow penetration from a mixing hole of the primary combustion chamber into at least one of a fuel flow and a primary mixing zone of the combustor;

expanding an annular fluid flow and a center fluid flow by disposing said venturi throat a predetermined distance upstream from the downstream end of the primary combustion chamber;

forming a plurality of dilution holes in the duct body of said transition piece, said dilution holes located at selected X, Y and Z coordinates measured from a zero reference point at a center of an exit plane of the transition piece; and guiding a cooling airflow through a passage defined by a gap extending between a wall of said centerbody and a turbulator member having a step portion, the turbulator member formed having a step-to-gap ratio relative to the centerbody of between about 0.8 and 1.2, the step-to-gap ratio enhancing air/fuel mixing and reducing an amount of the cooling airflow required by the combustor.

* * * * *